US008631601B2

(12) United States Patent
Langevin et al.

(10) Patent No.: US 8,631,601 B2
(45) Date of Patent: Jan. 21, 2014

(54) AUTOMATIC OR SEMIAUTOMATIC RIFLE WITH FOLDING CLAMSHELL BUTTSTOCK

(75) Inventors: Kevin Langevin, Berlin, CT (US); Paul Hochstrate, Plantsville, CT (US); Sachin Mistry, Pittsfield, MA (US); William Hartsig, Pittsfield, MA (US); Gregory Thune, Westerville, OH (US); Kevin Audibert, Wolcott, CT (US)

(73) Assignee: Colt Defense, LLC, West Hartford, CT (US)

( * ) Notice: Subject to any disclaimer, the term of this patent is extended or adjusted under 35 U.S.C. 154(b) by 0 days.

(21) Appl. No.: 12/246,452

(22) Filed: Oct. 6, 2008

(65) Prior Publication Data

US 2012/0137562 A1 Jun. 7, 2012

Related U.S. Application Data

(60) Provisional application No. 60/977,946, filed on Oct. 5, 2007, provisional application No. 61/096,713, filed on Sep. 12, 2008.

(51) Int. Cl.
*F41C 23/00* (2006.01)

(52) U.S. Cl.
USPC ..... 42/73

(58) Field of Classification Search
USPC ..... 42/71.01–74
See application file for complete search history.

(56) References Cited

U.S. PATENT DOCUMENTS

| | | | | | |
|---|---|---|---|---|---|
| 2,361,180 | A | | 10/1944 | Dobremysl | |
| 2,374,621 | A | * | 4/1945 | Reising | 42/72 |
| 2,400,349 | A | * | 5/1946 | Haberstump | 42/72 |
| 2,405,758 | A | * | 8/1946 | Sampson | 42/72 |
| 2,424,944 | A | | 7/1947 | Pratchett | |
| 2,441,487 | A | * | 5/1948 | Gordon | 42/72 |
| 3,209,482 | A | | 10/1965 | Kuzma et al. | 42/74 |
| 3,369,316 | A | * | 2/1968 | Miller | 42/72 |
| 3,380,183 | A | | 4/1968 | Miller et al. | |
| 3,817,148 | A | * | 6/1974 | Schirneker | 89/155 |
| 4,227,330 | A | * | 10/1980 | Chapin | 42/77 |
| 4,232,468 | A | * | 11/1980 | Chapin | 42/77 |
| 4,271,623 | A | * | 6/1981 | Beretta | 42/72 |
| 4,383,384 | A | | 5/1983 | Fox | 42/72 |
| 4,437,249 | A | * | 3/1984 | Brown et al. | 42/51 |
| 4,640,036 | A | * | 2/1987 | Gal | 42/72 |
| 4,735,007 | A | * | 4/1988 | Gal | 42/72 |
| 5,305,539 | A | | 4/1994 | Von Kuster | 42/75.01 |
| 6,560,911 | B2 | | 5/2003 | Sharp | 42/73 |
| 6,591,533 | B2 | * | 7/2003 | Wygant | 42/72 |
| 6,839,998 | B1 | | 1/2005 | Armstrong | 42/71.01 |
| 6,901,691 | B1 | * | 6/2005 | Little | 42/118 |
| 7,065,914 | B1 | * | 6/2006 | Wagner, II | 42/73 |
| 7,162,822 | B1 | | 1/2007 | Heayn et al. | 42/73 |
| 7,428,794 | B2 | * | 9/2008 | Oz | 42/73 |
| 7,493,718 | B2 | * | 2/2009 | Gorzen | 42/74 |

(Continued)

FOREIGN PATENT DOCUMENTS

| | | |
|---|---|---|
| CA | 2597441 | 7/2006 |
| WO | 2006115703 | 11/2006 |

*Primary Examiner* — Samir Abdosh

(74) *Attorney, Agent, or Firm* — Cantor Colburn LLP

(57) ABSTRACT

An automatic or semiautomatic blackrifle type rifle having a receiver and a bolt carrier movably coupled to the receiver. An action system is connected to the bolt carrier for cycling the bolt carrier in the receiver. A folding butt stock is connected to the receiver, the folding butt stock being both foldable and collapsible.

6 Claims, 34 Drawing Sheets

(56) References Cited

U.S. PATENT DOCUMENTS

| | | | | |
|---|---|---|---|---|
| 7,673,412 | B2 * | 3/2010 | Griffin | 42/73 |
| 7,802,392 | B2 * | 9/2010 | Peterson et al. | 42/75.03 |
| 7,827,721 | B2 * | 11/2010 | Griffin | 42/73 |
| 7,966,761 | B1 * | 6/2011 | Kuczynko et al. | 42/73 |
| 2005/0262752 | A1 | 12/2005 | Robinson et al. | |
| 2006/0026881 | A1 * | 2/2006 | Watley | 42/51 |
| 2007/0011932 | A1 * | 1/2007 | Oz | 42/94 |
| 2007/0028499 | A1 * | 2/2007 | DeLeeuw | 42/51 |
| 2008/0005951 | A1 * | 1/2008 | Gorzen | 42/14 |
| 2008/0028662 | A1 * | 2/2008 | Abraham et al. | 42/73 |
| 2009/0265973 | A1 * | 10/2009 | Calvete Zumalde | 42/51 |
| 2010/0212205 | A1 * | 8/2010 | Nill | 42/73 |

* cited by examiner

AUTOMATIC OR SEMIAUTOMATIC RIFLE WITH FOLDING CLAMSHELL BUTTSTOCK

This application claims benefit of priority of U.S. Provisional Application Ser. No. 60/977,946 filed on Oct. 5, 2007 and U.S. Provisional Application Ser. No. 61/096,713, filed Sep. 12, 2008 all of which are incorporated in their entirety herein.

BACKGROUND

1. Field

The disclosed embodiments relate to automatic or semiautomatic rifles and, more particularly, to rifles with a folding clamshell buttstock.

2. Brief Description of Related Developments

Utility of firearms, especially automatic or semiautomatic rifles for military and law enforcement users, is commensurate with the physical size of the rifle. Moreover, temporarily or transient conditions, such as space around a user or in an access way the user has to traverse, that may exist particularly in the military or law enforcement environments, may result in restrictions on the use of the rifle that may be adequately sized for other more general conditions. Thus, there is a desire for an automatic or semiautomatic rifle that is configurable to enable use in transient space restrictive conditions.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EMBODIMENT(S)

Figure 1:
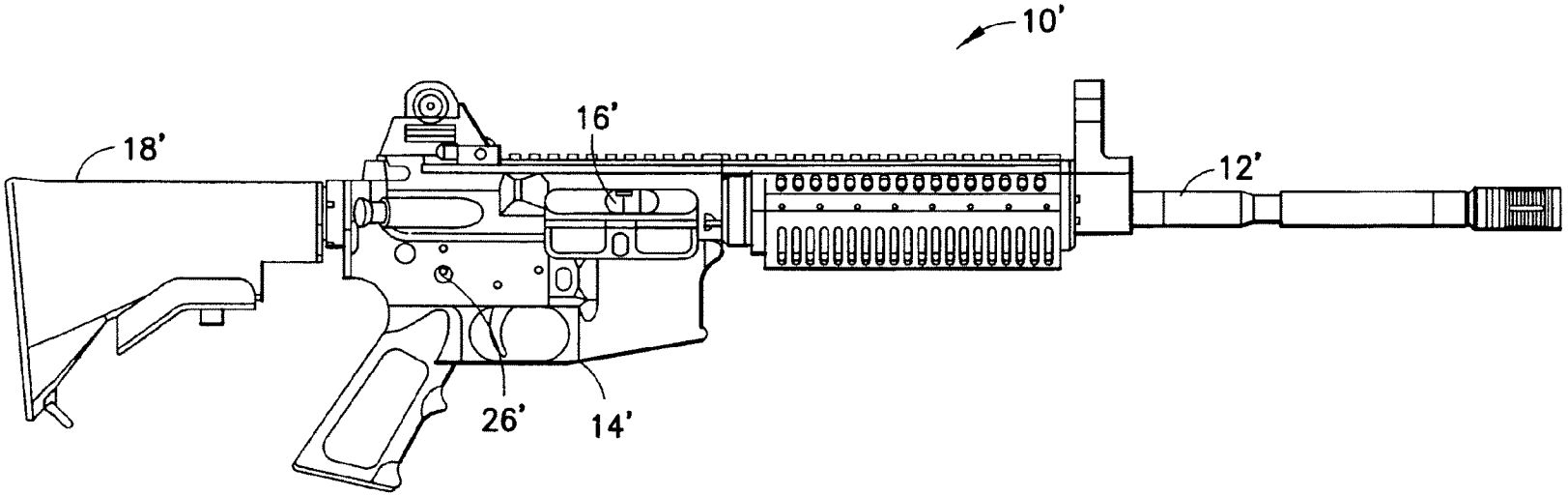
FIG. 1 is an isometric view of an automatic or semiautomatic firearm incorporating features in accordance with an exemplary embodiment.

Referring to FIG. 1, the firearm 10 may be an automatic or semi-automatic rifle. Firearm 10 may incorporate features similar to those disclosed in U.S. Patent Application Ser. Nos. 60/849,947 filed Oct. 6, 2006, 60/910,804, filed Apr. 9, 2007, and Ser. No. 11/869,679, filed Oct. 9, 2007, all of which are hereby incorporated by reference in their entirety. Firearm 10 is illustrated as generally having a black rifle configuration. The black rifle configuration is a term used for convenience to refer to the family of rifles developed by Eugene Stoner, for example, such as an M4™ rifle (available from Colt Defense, LLC) or M16 type automatic firearm configuration. However, the features of the disclosed embodiments, as will be described below, are equally applicable to any desired type of automatic firearm. Firearm 10 may have operational features such as disclosed in U.S. Pat. Nos. 5,726,377, 5,760,328, 4,658,702 and 4,433,610, and patent application Ser. No. 60/564,895; Ser. No. 10/836,443 filed respectively on Apr. 23, 2004 and Apr. 30, 2004, all of which are hereby incorporated by reference herein in their entirety. The firearm 10 and its sections described in greater detail below is merely exemplary, and in alternate embodiments the firearm 10 may have other sections, portions or systems. For example, firearm 10 may incorporate a hand guard, a receiver section, a barrel, and stock. The rifle 10, illustrated substantially in FIG. 1, generally has a lower receiver 14, an upper receiver 16, a barrel 12 and stock 18. The upper receiver 16 may be connected to the lower receiver to form a receiver assembly. The barrel 12 may be connected to the receiver assembly as is the stock 18. The firearm may have a hand guard over the barrel. An example of a suitable hand guard for firearm 10 is described in U.S. Pat. No. 4,663,875, issued May 12, 1987, incorporated by reference herein in its entirety. Other examples of suitable hand guards are described in U.S. patent application Ser. No. 11/113,525 filed on Apr. 25, 2005, incorporated by reference herein in its entirety. An example of a suitable upper receiver is disclosed in U.S. Patent Publication No. US 2006/0236582, published Oct. 26, 2006, incorporated by reference herein in its entirety. The configuration of the firearm 10 in the exemplary embodiment illustrated in FIG. 1 is merely representative, and the features of the exemplary embodiments described below with specific reference to the figures are equally applicable to any suitable firearm with any desired configuration. For example, except as otherwise noted, the firearm may have features, such as the upper receiver, lower receiver, operating mechanism, barrel, hand guard that are generally similar to the M4™ rifle available from Colt Defense LLC. In alternate embodiments, the firearm may have any other desired configuration and features as noted before, the firearm 10 in the exemplary embodiment may be a rifle capable of automatic or semi-automatic fire. The firearm 10 may have an operating system, for example actuated by exhausting barrel gases, that cycles a bolt carrier in the upper receiver to effect automatic or semi-automatic operation of the firearm. The operating system may be direct gas impingement operating system, or in alternate embodiments may be an indirect or gas piston operating system. Suitable examples of gas piston operating systems are described respectively in U.S. patent application Ser. No. 11/231,063 filed on Sep. 19, 2005, U.S. patent application Ser. No. 11/352,036 filed Feb. 9, 2006, U.S. Provisional Patent Application No. 60/772,494 filed Feb. 9, 2006 and U.S. Provisional Patent Application No. 61/096,697, filed Sep. 12, 2008, all incorporated by reference herein in their entireties. The firearm 10 may have a selector mechanism 26, that interfaces with the firearm trigger system 28 to allow operator selection between, for example "AUTO" (automatic) "SEMI" (semi-automatic) and "SAFE" (safety) operating modes. In alternate embodiments, the selector mechanism may be different. Cycling of the bolt carrier may be effected by the operating system (as noted before) in cooperation with a bolt carrier return system described in greater detail below. The bolt carrier return system may be located in the stock portion 18 of firearm 10. In the exemplary embodiment shown in FIG. 1, the stock 18 may be an articulated stock as will also be described in greater detail below. Stock 18 may have features as disclosed in U.S. patent application Ser. No. 11/869,679 filed Oct. 9, 2007 and U.S. Provisional Patent Application Ser. No. 61/096,713 filed Sep. 12, 2008, both of which are incorporated by reference herein in their entirety. The stock 18 may also have a telescoping or extendable portion providing stock with selectably variable length.

Figure 2:
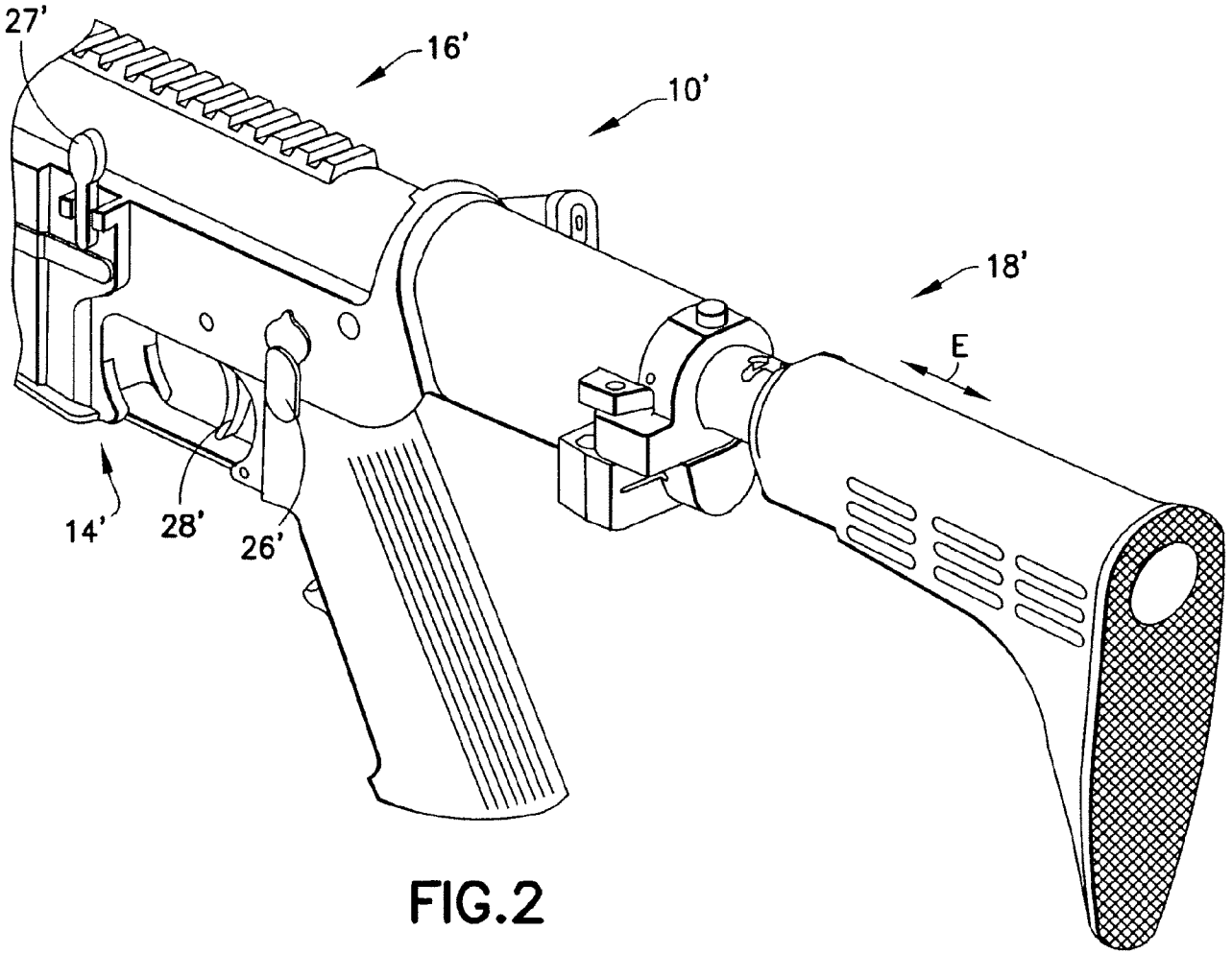
FIG. 2 is a partial isometric view of the firearm in accordance with another exemplary embodiment.
Figure 3:
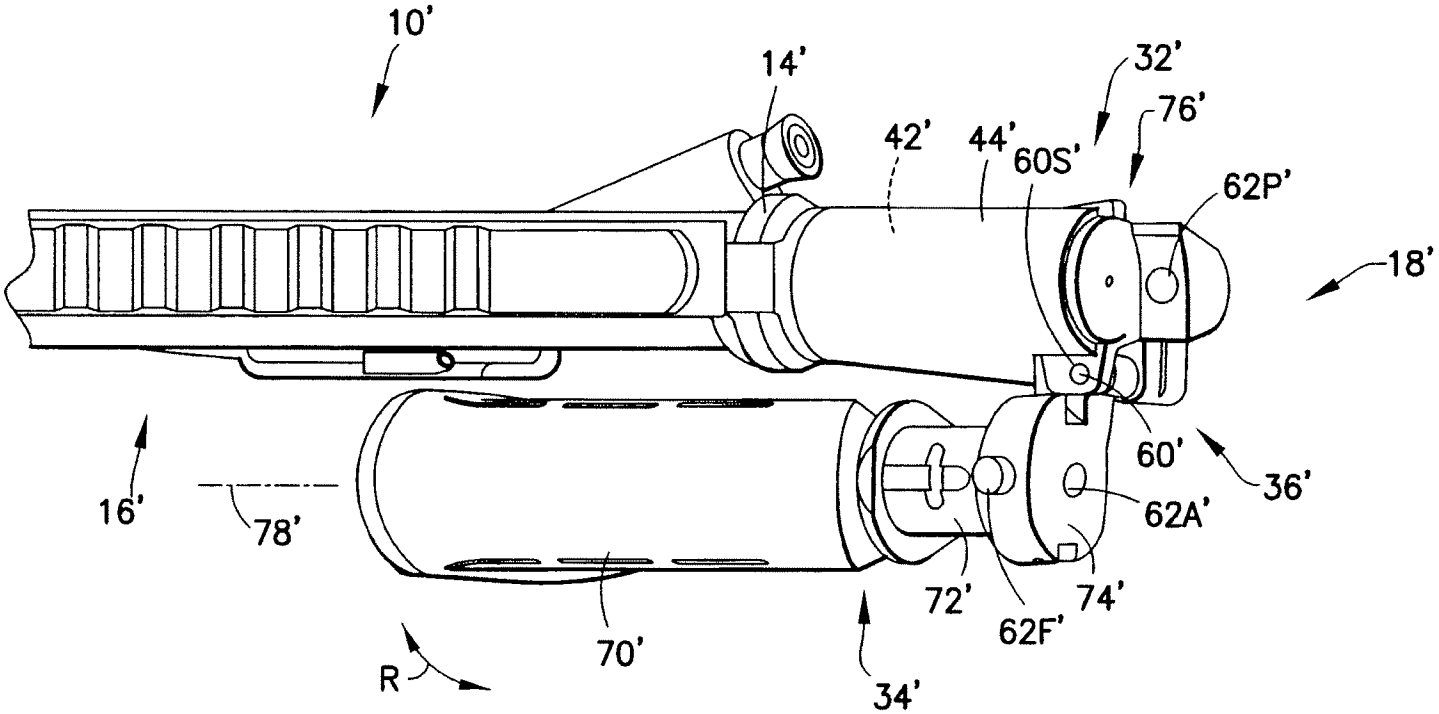
FIG. 3 is a partial top isometric view of the firearm with a portion of the firearm in another position.

Referring now to FIG. 3, there is shown a top isometric view of firearm 10. In the exemplary embodiment shown, the articulated stock is a folding stock 18 shown in a folded position in FIG. 3. Further, as may be realized from FIG. 2, the firearm may be configured with the folded stock extended or moved (such as in the directions indicated by arrows E, R in FIGS. 2, 3) to a representative extended position. As seen best in FIG. 3, in the exemplary embodiment, the stock 18 may have what may be generally referred to as a base portion 32 and folding portion 34. In the exemplary embodiment, the base portion 32 of the stock 18, mates the stock to the lower receiver 14.

Figure 4:
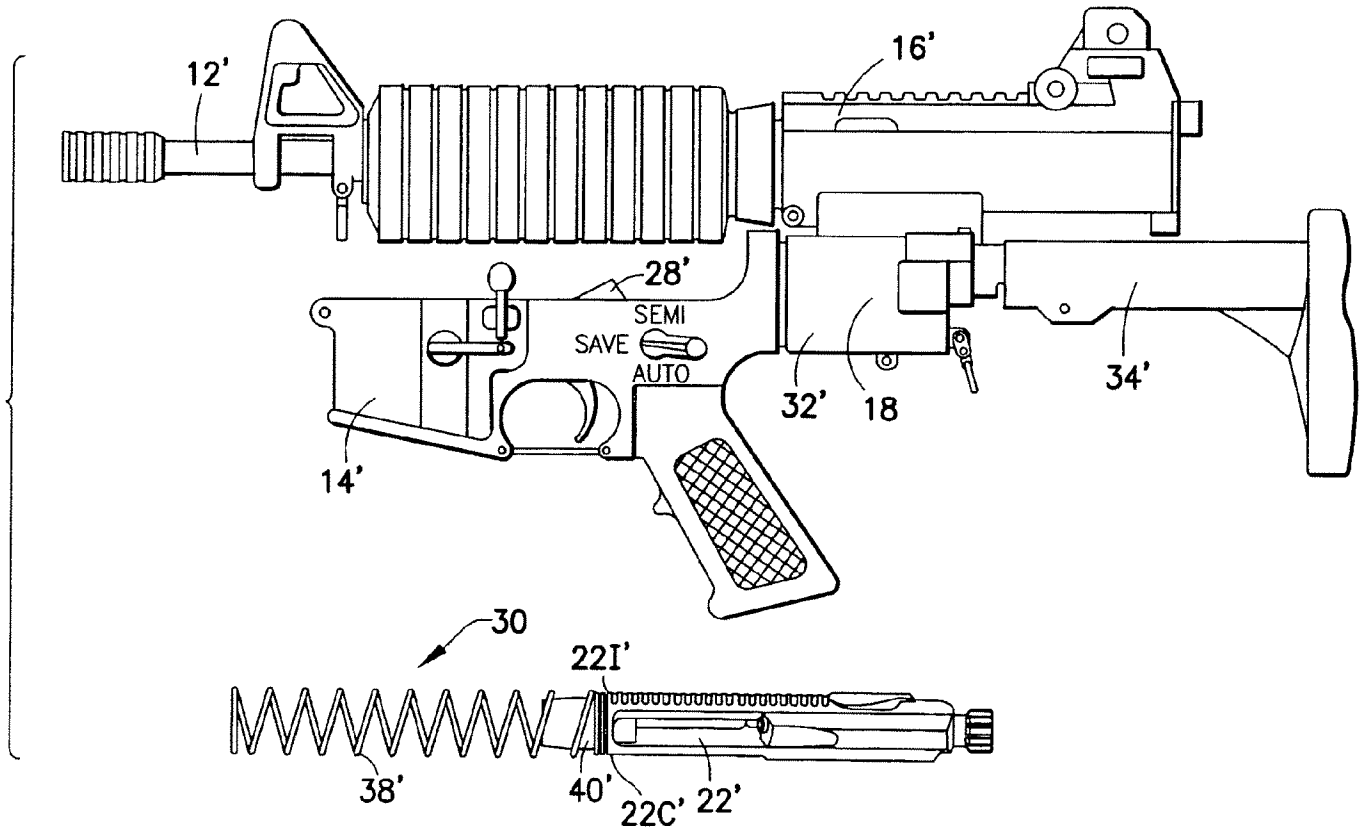
FIG. 4 is an exploded view of the firearm with a folding stock.
Figure 5:
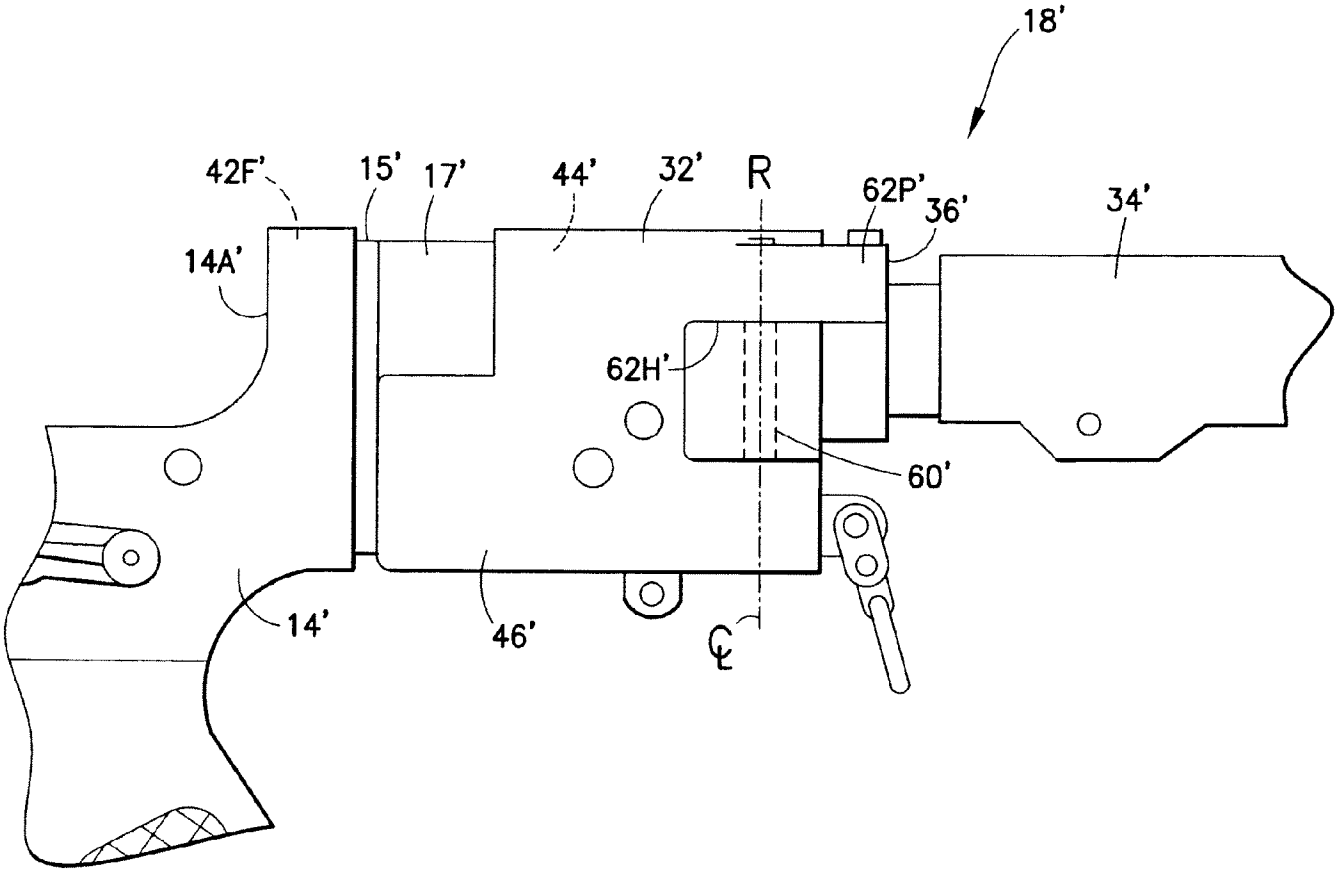
FIG. 5 is a partial side view of the firearm with a folding stock shown in yet another position.
Figure 6:
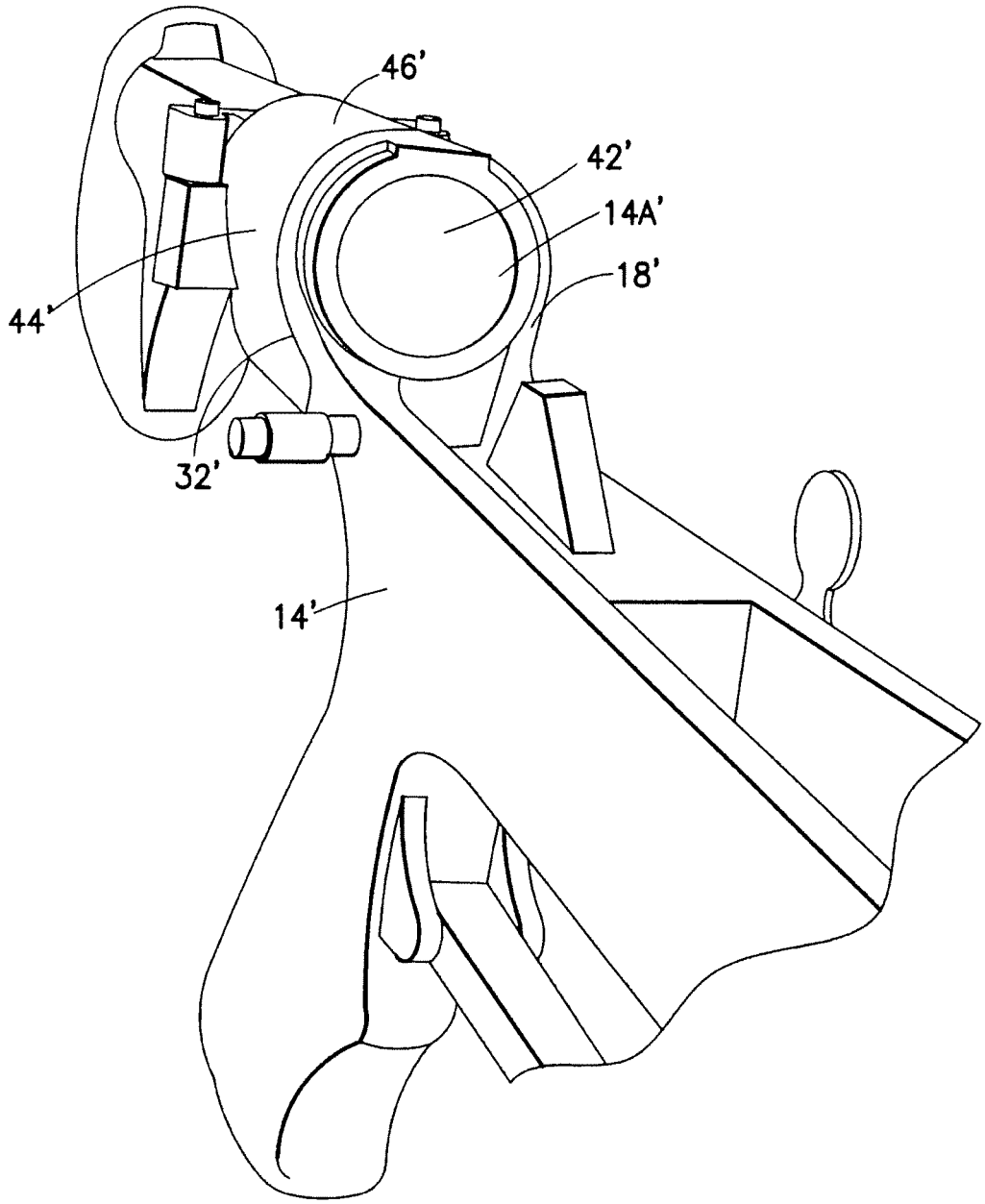
FIG. 6 is another partial perspective view of the firearm as seen from the front (with part of the receiver removed for clarity)

Referring now to FIG. 4, there is shown another side elevation view of the firearm 10 with the upper receiver disassembled from the lower receiver 14, and the bolt carrier 22 and bolt carrier return or action system 30 outside the firearm. As may realized, the bolt carrier 22 is movably mounted inside the upper receiver 16. The action system 30 is interfaced with and engages the bolt carrier to return the carrier 22 to its battery position during each operating cycle. In the exemplary embodiment, the bolt carrier action system 30 has an action spring(s) 38 (one spring is shown for example though there may be any number of action springs arranged in any desired configuration, parallel, series, and any suitable resilient system may be used including pneumatic springs) and a buffer 40 as will be described further below. The action system 30 may be housed, at least in part, within the base portion 32 of the stock 18. Referring also to FIGS. 5 and 6, there is shown respectively a partial left elevation view of the firearm lower receiver 14 and stock 18, and a partial front elevation of lower receiver and stock. As will be described in greater detail below, the stock base portion 32, connecting the stock 18 to the rear end of the lower receiver, generally included a receiver extension member 42, a base 44 and a stock base housing 44. In alternate embodiments, the base portion may have any other desired configuration. In the exemplary embodiment, the receiver extension member 42 is communicably connected to the lower receiver 14. The receiver extension member 42 is located in the base 44, and the base is located within the stock base housing 44, as will also be described further below.

Figure 9:
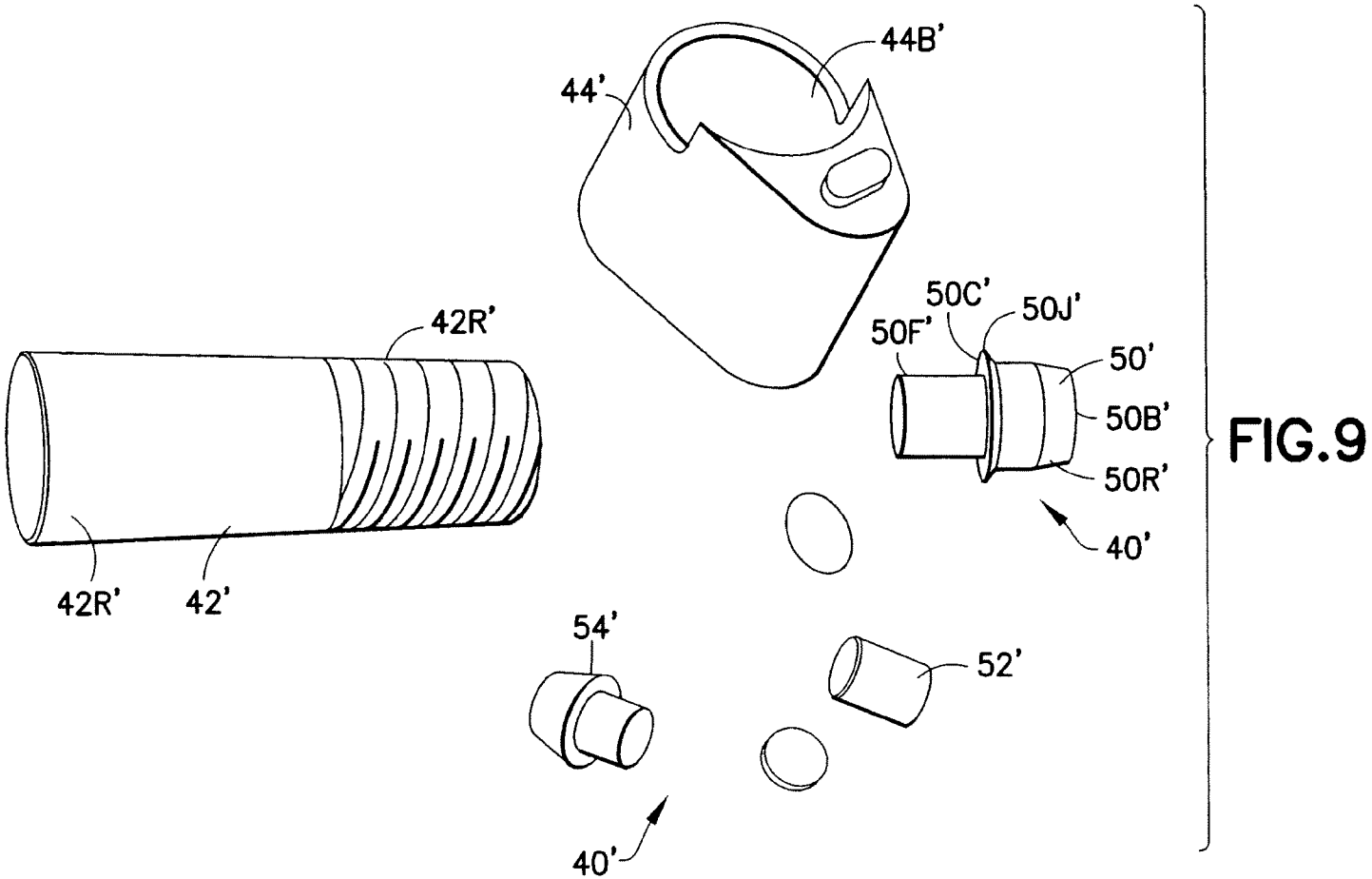
FIG. 9 is an exploded view of an extension assembly portion of the firearm.

The receiver extension 42 and base 44, in the exemplary embodiment, are shown in FIG. 9. FIG. 9 also illustrates the buffer 40 of the exemplary embodiment in a disassembled condition. In the exemplary embodiment, the receiver extension member 42 may have a generally hollow cylindrical shape. The receiver extension member is sized and shaped to house and allow desired movement of the bolt carrier action system 30 and bolt carrier 22 as the bolt carrier is cycled during operation of the firearm. In alternate embodiments, the receiver extension member may have any other desired shape. In the exemplary embodiment, the bore within the receiver extension member 42 may be sized to stably support the helical action spring 38, of the bolt carrier action system 30 (see also FIG. 4) and allow unimpaired deflection of the spring as the bolt carrier cycles. As noted before, in alternate embodiments any suitable spring or bolt carrier return system may be used. The bore may also define a guide way for movement of the buffer 40 and bolt carrier 22 when the bolt carrier cycles during operation of the firearm. In the exemplary embodiment, the rear of the receiver extension member has a support surface 42R against which the action spring 38 may be biased as desired. In the exemplary embodiment shown in FIGS. 5-6, the extension member 42 may have an end cap or flange (not shown), with a vent opening therein, for maintaining desired pressure within the receiver and extension member as the bolt carrier is cycled during firearm operation. In alternate embodiment, the extension member, may be provided with a regulator, communicating with the receiver, to allow immediate firing after water submersion regardless of weapon orientation. A suitable example of a receiver extension regulator is described in U.S. patent application Ser. No. 11/026,142 filed on Dec. 30, 2004, incorporated by reference herein in its entirety.

Figure 7:
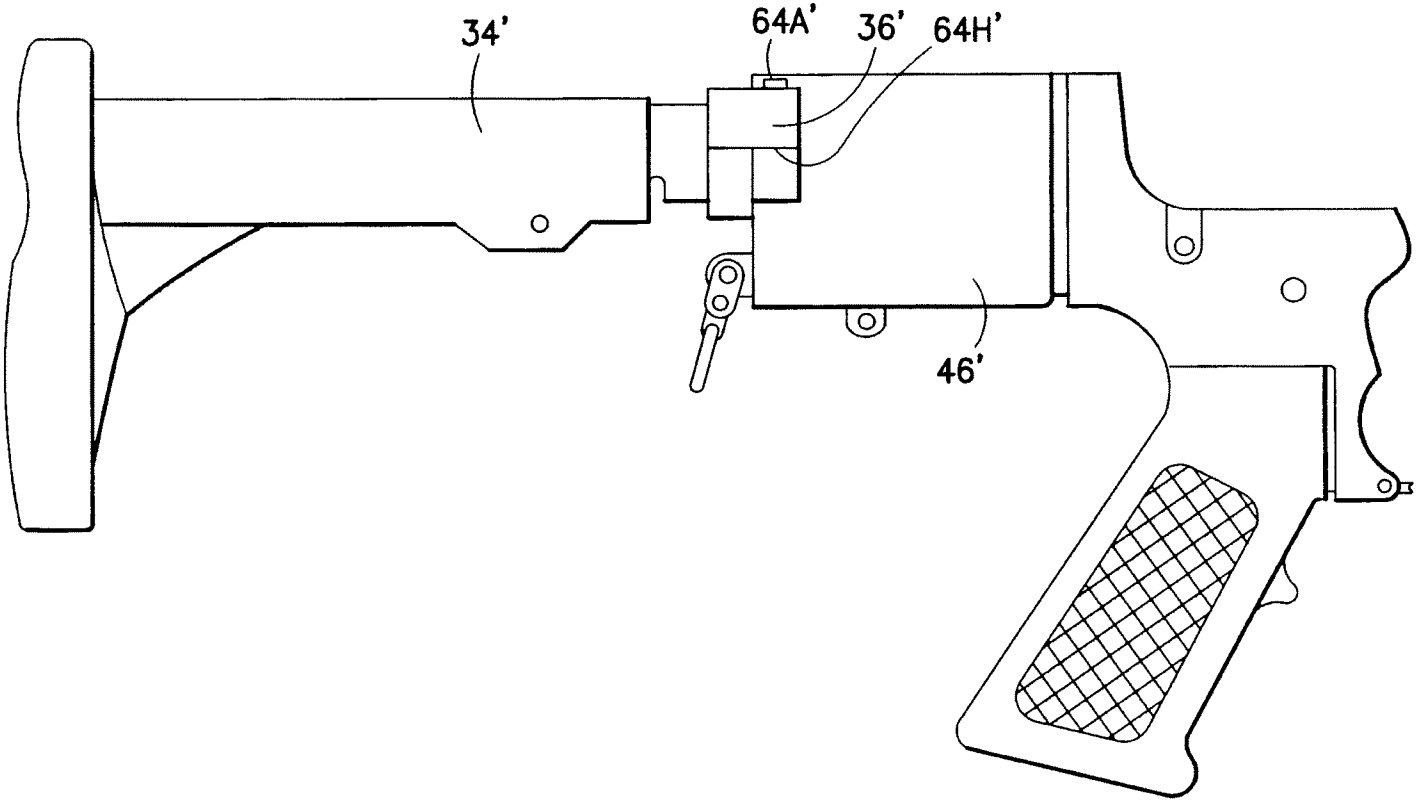
FIG. 7 is a partial side view of the firearm with a folding stock.
Figure 8:
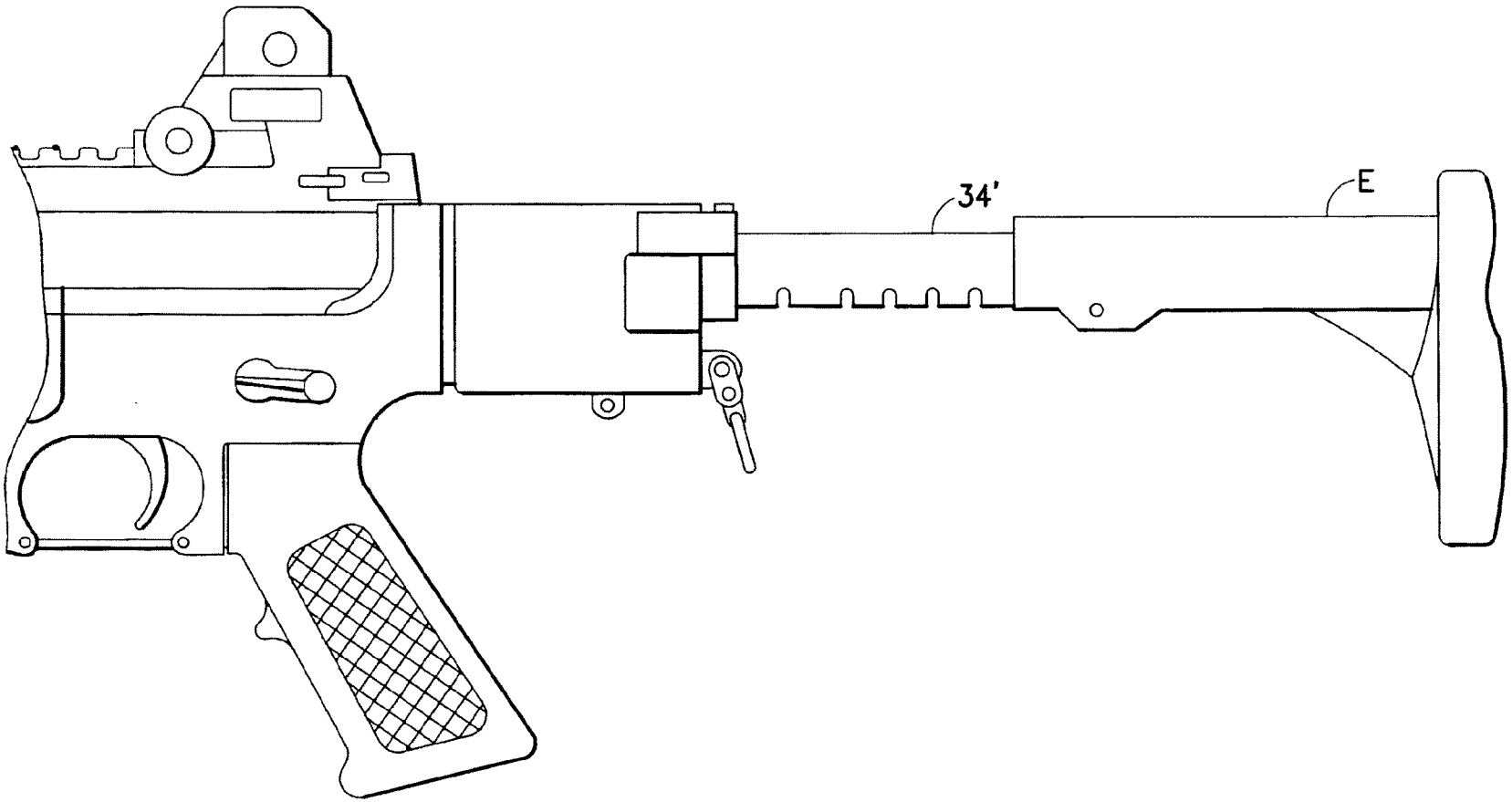
FIG. 8 is a side view of the firearm with a folding stock shown in still another position.

As seen in FIG. 9, in the exemplary embodiment the extension member 42 may have a threaded portion 42F at its front end for engagement to the receiver 14 of the firearm (see also FIGS. 5, 6). As noted before, the firearm lower receiver 14 may have features similar to the lower receiver of an M4™ rifle available from Colt Defense, LLC. As seen in FIGS. 5 and 6, the lower receiver may for example have an aperture 14A, that may be substantially in line with the bolt carrier (and bolt carrier action) when the bolt carrier is installed in the assembled receiver, and that allows engagement of the receiver extension member to the receiver. In the exemplary embodiment, the receiver aperture 14A may have internal threads allowing the extension member 42 to be threaded into the aperture, thereby mounting the extension member 42, and the stock 18 as will be described below, to the receiver. In alternate embodiments, the extension member may be mounted to the receiver in any other desired manner. As can be seen in FIGS. 5, 7 and 8 in the exemplary embodiment, the extension member 42 may be rotationally locked to the receiver by locking ring 17, and locking collar 15. The ring 17 may be fixed rotationally to the extension member when the extension member is sufficiently threaded in the receiver aperture. The locking ring 17 may also be rotationally fixed to the locking collar 15, that is in turn fixed to the receiver (for example by threading the locking ring on the extension member causing engagement between locking detents on the ring, collar and the receiver). As may be realized, the extension member 42 in the exemplary embodiment is substantially shorter than a conventional receiver extension tube of a "black rifle" such as an M4™ rifle. The extension member 42 is sized so that in cooperation with the action system 30, it allows the desired action of the bolt carrier action system 30 and bolt carrier 22 at a desired cycle rate when operating the firearm. For example, the rifle 10 may have a cycle rate similar to the cycle rate of an M4™ rifle. In alternate embodiments, the firearm may have any other desired cycle rate. In the exemplary embodiment the extension member 42 may have a minimum length of about 3.3", though in alternate embodiments, the extension member may have a length that is more or less.

Referring now again to FIG. 4, the bolt carrier 22 and bolt carrier action system 30 are shown in an assembled condition. As noted before, the bolt carrier action system 30 has an action spring 38 and buffer 40 that operate on the bolt carrier 22. In the exemplary embodiment, the action system 30 and bolt carrier 22 are compact, relative to the conventional bolt carrier and action system of an M4™ rifle, in order to operate with the compact receiver extension member 42 described before. The bolt carrier 22 in the exemplary embodiment may have features similar to the bolt carrier of a M4™ rifle except as otherwise noted. The bolt carrier 22 may have an interface 22I that interfaces the bolt carrier 22 to the action system 30. In the exemplary embodiment, the bolt carrier 22 may have a buffer coupling 22*c* at the rear that allows coupling between the bolt carrier 22 and buffer 40 and hence the action system 30. The coupling 22C may include a buffer receiving aperture/opening sized and shaped for receiving a portion of the buffer 40 as will be described further below. The coupling 22C may also include seating surfaces for seating the buffer, along the axial direction of the bolt carrier, against the bolt carrier. In the exemplary embodiment, the bolt carrier 22 may have a rear ring that defines the buffer receiving aperture and buffer seating surface(s) of the coupling 22C. In alternate embodiments, the buffer coupling on the bolt carrier may have any other desired configuration. In the exemplary embodiment action spring(s) 38 (as one or more may be used) may have a generally helical shape. The action spring 38 may be sized as desired to provide in cooperation with the buffer 40 suitable action to the bolt carrier 22I in view of the length of the receiver extension member 42 and size and mass of the bolt carrier 22. In alternate embodiments any suitable bolt carrier action spring or return system may be used. In the exemplary embodiment, the buffer 40 may be an assembly including an outer casing 50, interior mass 52 and cap 54. The disassembled elements 50-54 of the buffer assembly 40 are shown in FIG. 9, and the assembled buffer 40 is seen best in FIG. 4. In the exemplary embodiment, the casing 50 may be a one-piece member (i.e. unitary construction) made of metal such as 4140 steel, though any other suitable materials (for example including non metallic materials) may be used for forming the casing. In alternate embodiments, the buffer casing may be made in any other desired manner. The casing may have a front portion 50F, a mid-portion and rear portion 50R. The front portion 50F is sized and shaped (in the exemplary embodiment shown the front portion may be generally cylindrical) to conform with the buffer receiving opening in the coupling 22C of the bolt carrier. As may be realized, the front section 50F of the buffer 40 may thus be inserted into and stably held within the bolt carrier coupling 22C as seen in FIG. 4. Thus, the buffer may be entrant, at least in part in the bolt carrier. The casing 50 may have stops 50C that seat against seating surfaces on the bolt carrier to position the front portion 50F of the buffer 40 axially relative to the bolt carrier. As may be realized from FIG. 7B, the length of the front section is sized so that when coupled to the bolt carrier, the front portion 50F extending in the bolt carrier is positioned to avoid interfering with the action of the hammer (not shown) operating against the firing pin FP. In the exemplary embodiment the casing may have a shoulder or flange defining stops 50C. In alternate embodiments, the stops on the casing may be formed in any desired manner. The rear portion 50R is generally configured so that the coils of action spring 38 may be positioned around the rear portion of the buffer. In alternate embodiments, the rear portion of the buffer may have any desired shape. The casing may also include seating surfaces 50S for axial seating the spring 38 against the buffer casing. The seating surfaces 50S may be generally opposed to stops 50C. As may be realized, when assembled (as shown in FIG. 4) the action spring 38 is biased against seating surfaces 50S in turn biasing the buffer via contact surfaces 50C against the buffer. In the exemplary embodiment the casing 50 may have an inner chamber/bore 50B. The bore 50B is sized to slidably hold mass 52 therein. Mass 52 may be made of tungsten or any other suitable material (though one mass is shown in alternate embodiments the buffer may have more masses). The mass 52 and bore 50B are sized to allow the mass to slide freely, but substantially axially, within the bore 50B. The sliding mass 52 inside the casing defines a further inertia capacitor to the bolt carrier delivering an impulse load to the bolt carrier upon its return to the battery position by the action system. The bore 50B may have an opening at the rear end, through which the mass may be placed inside the casing bore and which is capped with cap 54. As noted before, the action system 30 is positioned in the firearm with the rear of the action spring 38 located in the receiver extension member 42, seated against the end 42R of the extension member 42. The upper and lower receivers 16, 14 may be coupled (with the bolt carrier 22 housed in the upper receiver), the buffer and action spring being resiliently moved to the rear to clear the upper receiver frame and bolt carrier during coupling. On coupling of the upper and lower receivers, the buffer (biased by spring 38) automatically engages and couples with the bolt carrier 22. As may be realized the compact receiver extension 42, bolt carrier 22 and action system 30, in the exemplary embodiment results in the action spring 38 and the support surface 42R supporting the spring, and the action loads imparted thereby, being located closer to the center of mass of the firearm, and to the ergonomic hand grips. This contributes to improved stability and reduced reaction forces on the user when operating the firearm 10 compared to conventional rifles.

Referring again to FIG. 9, the base 44 has a bore 44B formed therein allowing the base to be mounted to the receiver extension 42. In the exemplary embodiment, the base forms a mounting interface or bracket for mounting the base housing 46 (see FIG. 5) of the stock 18 to the receiver extension 42 and hence, the firearm. The base 44 in the exemplary embodiment shown in the figures has a representative configuration and in alternate embodiments, the base may have any other desired arrangement. The base may be made from any suitable material such as aluminum and may be of unitary construction. The base 44 may be fixed to the receiver extension 42 for example, by a takedown pin engaging a detent on the receiver extension, or any other desired position fixing devices/features. As seen in FIG. 9, in the exemplary embodiment the base may have a recess generally conforming to the locking ring 17 on the receiver extension (see FIG. 5). In the exemplary embodiment, the base may have locating features (e.g. detents) to positionably locate the base with respect to the firearm receiver.

Referring now again to FIGS. 3 and 4-8, in the exemplary embodiment the stock base housing 46 is mounted to the stock base 44. In the exemplary embodiment the stock base housing 46 may be a one piece member, made of suitable material such as a non-metallic material (e.g. plastic). The stock base housing 46 may have a suitable interior passage or opening, for example conforming to the shape of the base 44, and allowing the stock base housing 46 to be mounted to the base by for example sliding the stock base housing over the base. The base and housing 46 may be provided with suitable interlocking detents (e.g. lock pin and receptacle) to fix the housing to the base. The interlocking detents may be spring loaded for automatic engagement. In alternate embodiments, the base and housing may be formed as a one piece member (i.e. of unitary construction). In alternate embodiments, the base and housing may have interlocking detents with more than one selectable position allowing for example telescoping position between housing and base for a stock base of selectable variable length. As noted before the shape of the stock base housing 46 in the illustrated embodiments is merely exemplary, and in alternate embodiments the stock base housing may have any other suitable shape. Coupling 36 connects the end or folding portion 34 of the stock 18 to the base portion 32 and particularly in the exemplary embodiment, to the stock base housing 46. FIG. 3 shows the stock 18 in the folded position, and FIG. 4 illustrates the stock in the deployed or unfolded position. In the exemplary embodiment, coupling 36 incorporates a single degree of freedom, (e.g. a single axis of rotation R as shown in FIG. 5). In alternate embodiments, the coupling may have multiple degrees of freedom (e.g. multiple axis of rotation allowing the folding portion to be rotated to either side and/or rotated vertically). In other alternate embodiments, the coupling between the base and portion of the stock may be substantially rigid and not otherwise capable of folding. The coupling may also include a quick release allowing rapid removal and reinstallation of the folding or end stock portion 34 from the stock base 32. The configuration of the coupling 36 in the illustrated embodiments is merely exemplary, and in alternate embodiments the coupling may have any other suitable configuration. In the exemplary embodiment, the coupling 36 may have a hinge 60 (corresponding to axis of rotation R see FIGS. 3 and 5) located to allow the folding portion to be rotated to the left side. Spring loaded detents 62P, 62A engage automatically to lock the folding portion in its folded position. A push pin or other suitable release device is provided in the exemplary embodiment to disengage the detents and unlock the folding portion from its folded position. Interfacing seating surfaces on the folding portion and stock base housing fix the folding portion to the base when the folding portion is in its deployed position (see FIGS. 5, 7). In the exemplary embodiment, spring loaded detents 64P, 64H (see FIG. 7) engage automatically to lock the folding portion in its deployed position. A push pin is provided in the exemplary embodiment to disengage the detents, and unlock the folding portion from its deployed position. As noted before, in the exemplary embodiment the folding portion 34 incorporates a telescoping system allowing the folding portion to have a selectably variable length. The length of the folding portion may be adjusted/selected as desired with the folding portion in either the folded or deployed positions. The folding portion 34 is shaped so that the operating mode selector 26 is readily accessible by the operator when the folding portion 34 is in its folded position and telescoped in (i.e. min. length). The operator may thus easily operate the firearm with the stock in any position. As may be realized, any M4™ rifle or other firearm having a black rifle configuration, may be configured in accordance with the exemplary embodiments as described above by replacing the conventional bolt carrier, action system and stock with the bolt carrier 22, action system 30 and stock 18 of the exemplary embodiment.

Figure 10:
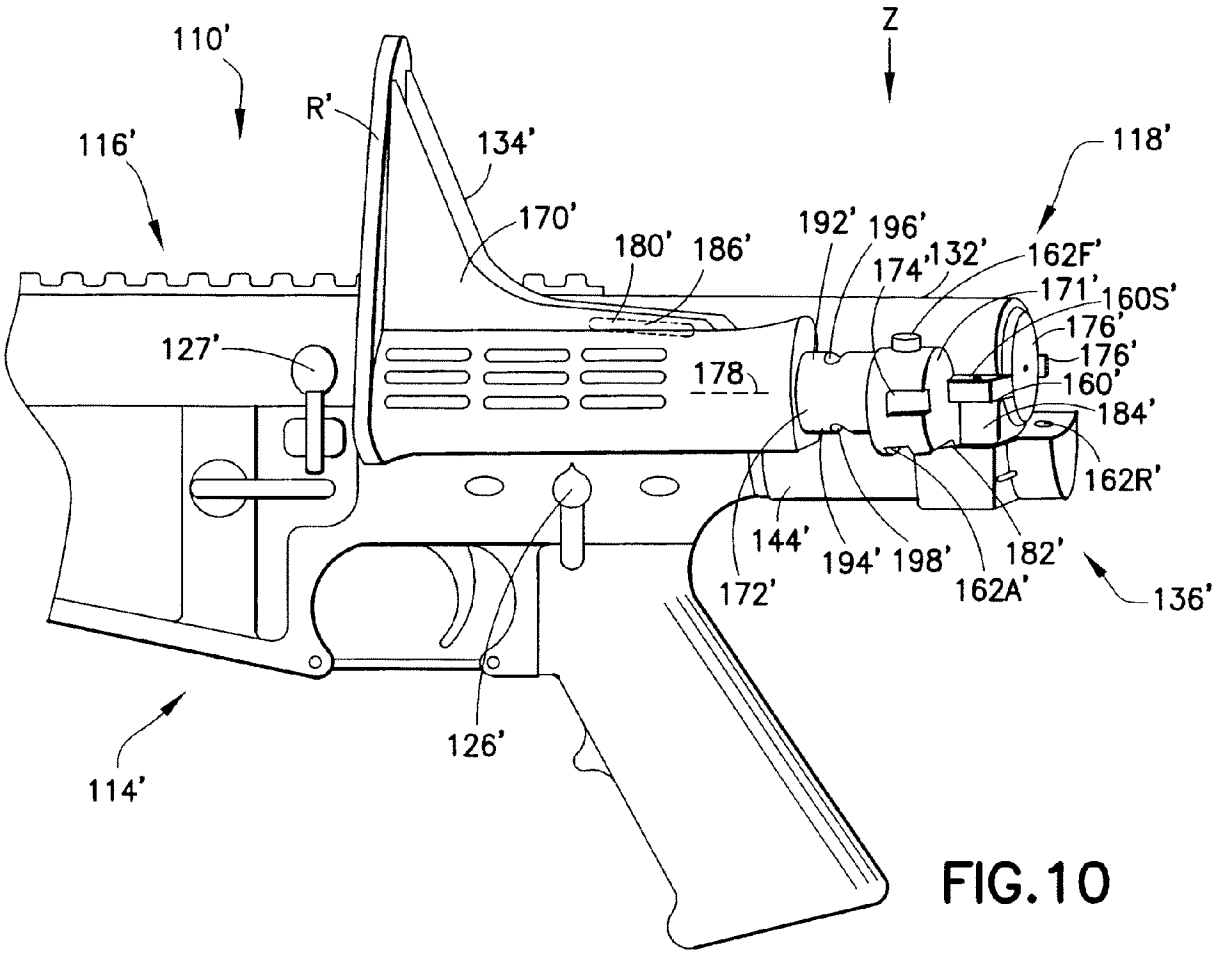
FIG. 10 is a side elevation view of the firearm with a folding stock shown in still another position.

Referring now to FIG. 10, there is shown a partial perspective view of a firearm 110 in accordance with another exemplary embodiment. Firearm 110 may be similar to firearm 10 described previously except as otherwise noted (and similar features are similarly numbered). The rifle 110 generally has a lower receiver 114, an upper receiver 116, a barrel (not shown) and stock 118. The firearm 110 may have a selector mechanism 126, that interfaces with the firearm trigger system 128 to allow operator selection between, for example "AUTO" (automatic) "SEMI" (semiautomatic) and "SAFE" (safety) operating modes. Cycling of the bolt carrier may be effected by the operating system (as noted before) in cooperation with a bolt carrier return system similar to that described previously. The bolt carrier return system may be located in the stock 118 of firearm 110. In the exemplary embodiment shown in FIG. 10, the stock 118 may be capable of folding similar to that described before. The stock 118 may also have a telescoping or extendable portion providing stock with selectably variable length. FIG. 10, shows a side elevation view of the firearm 110 with folding stock 118 in a folded position R'. In the exemplary embodiment, the stock 118 may also be capable of being extended in length (e.g. may have a telescoping feature) as will be described further below. The base portion 132 of the stock 118, mates the stock to the lower receiver 114. In the exemplary embodiment, the folding portion 134 may be joined to the base portion 132 by a coupling 136 that allows the folding portion 134 to be folded, or rotated relative to the base portion 118 from a deployed position to a folded or stowed position(s). In the exemplary embodiment illustrated in the figures, the folding portion is shown for example folded on the left side of the firearm. In alternate embodiments, the folding portion of the stock may have more than one folded position. For example the folded portion of the stock may be folded down or on the right side of the firearm. In other alternate embodiments, the folding portion may be moved to any other desired folded position.

An action system (not shown) but similar to action system described before) may be housed, at least in part, within the base portion 132 of the stock 118. The stock base portion 132, connecting the stock 118 to the rear end of the lower receiver houses a receiver extension member within a stock base housing 144. In alternate embodiments, the base portion may have any other desired configuration. In the exemplary embodiment, the receiver extension member may have a generally hollow cylindrical shape and may be sized and shaped to house and allow desired movement of the bolt carrier action system and bolt carrier as the bolt carrier is cycled during operation of the firearm. The bolt carrier and bolt carrier action system (e.g. buffer, recoil spring) may be similar to the exemplary embodiments described. Base 144 has a bore formed therein allowing the base to be mounted to the receiver extension. In the exemplary embodiment, the base forms a mounting interface or bracket for mounting the base housing 144 of the stock 118 to the receiver extension and hence, the firearm. The base 144 in the exemplary embodiment shown in the figures has a representative configuration and in alternate embodiments, the base may have any other desired arrangement. The base may be made from any suitable material such as aluminum and may be of unitary construction. The base 144 may be fixed to the receiver extension by any suitable means as will be described in greater detail below. In alternate embodiments the stock base 144 may be a one piece member, made of suitable material such as a non-metallic material (e.g. plastic). The stock base 144 may have a suitable interior passage or opening, for example conforming to the shape of the receiver extension, and allowing the stock base 144 to be mounted to the extension for example by sliding the stock base over the extension. The base 144 and extension or lower receiver may be provided with suitable interlocking detents (e.g. lock pin and receptacle) to fix the base to the receiver. The interlocking detents may be spring loaded for automatic engagement. In alternate embodiments, any suitable fastening technique may be used. In alternate embodiments, the base may be formed as a multi piece member (i.e. instead of unitary construction, made of multiple components). In alternate embodiments, the base and lower receiver or extension may have interlocking detents with more than one selectable position allowing for example telescoping or rotational position between the receiver and base for a stock base of selectable variable length or rotational position.

Coupling 136 connects the end or folding portion 134 of the stock 118 to the base portion 132 and particularly in the exemplary embodiment, to the stock base 144. In the exemplary embodiment, coupling 136 incorporates a single degree of freedom, for example, a single axis of rotation. In alternate embodiments, the coupling may have multiple degrees of freedom (e.g. multiple axis of rotation allowing the folding portion to be rotated to either side and/or rotated vertically). The coupling may also include a quick release allowing rapid removal and reinstallation of the folding stock portion 134 from the stock base 132. The configuration of the coupling 136 in the illustrated embodiments is merely exemplary, and in alternate embodiments the coupling may have any other suitable configuration. In the exemplary embodiment, the coupling 136 may have a hinge 160 located to allow the folding portion to be rotated to the left side. In the exemplary embodiment, the folding portion 134 may be spring loaded in the folding position shown in FIG. 9. For example, a torsion spring 160S may be positioned between the folding portion 136 and base to bias the folding portion to the folded position. The spring may be configured as desired to generate sufficient bias to hold the folding portion 136 in the folded position throughout any desired operation of the firearm. In alternate embodiments, other hinge locations may be provided, for example, a center or left hand hinge location. In other exemplary embodiments, spring loaded detent 182 may be provided on base portion 132 for mating portion 184 on folding portion 134 to hold the folding portion 134 in the folded position (see FIG. 10). Spring loaded detents 162P, 162A engage automatically to lock the folding portion in its unfolded position. Push pin 162F is provided in the exemplary embodiment to disengage the detents and unlock the folding portion from its unfolded or deployed position. The arrangement of the spring loaded detents and push pin is merely exemplary. The push pin 162F may be pressed in the direction indicated by arrow Z pushing the push pin to engage detent 162P. As may be realized, the push pin deflects the detent causing it to disengage the folding portion and allowing folding stock portion 132 to be released. Interfacing seating surfaces 174, 176 on the folding portion 134 in the exemplary embodiment and stock base housing 144 fix the folding portion 134 to the base 144 when the folding portion is in its deployed position. When folding portion 134 is in the deployed position, protrusion 176 is seated within mating slot 174 and providing additional structural support. In alternate embodiments, interfacing surfaces between folding portions 134 and base 144 may be provided in any desired arrangement for stably holding and positioning the folding portion when in the unfolded position. In the exemplary embodiment, spring loaded detent 162P engages mating recess 162A automatically to lock the folding portion in its deployed (unfolded) position.

Figure 14:
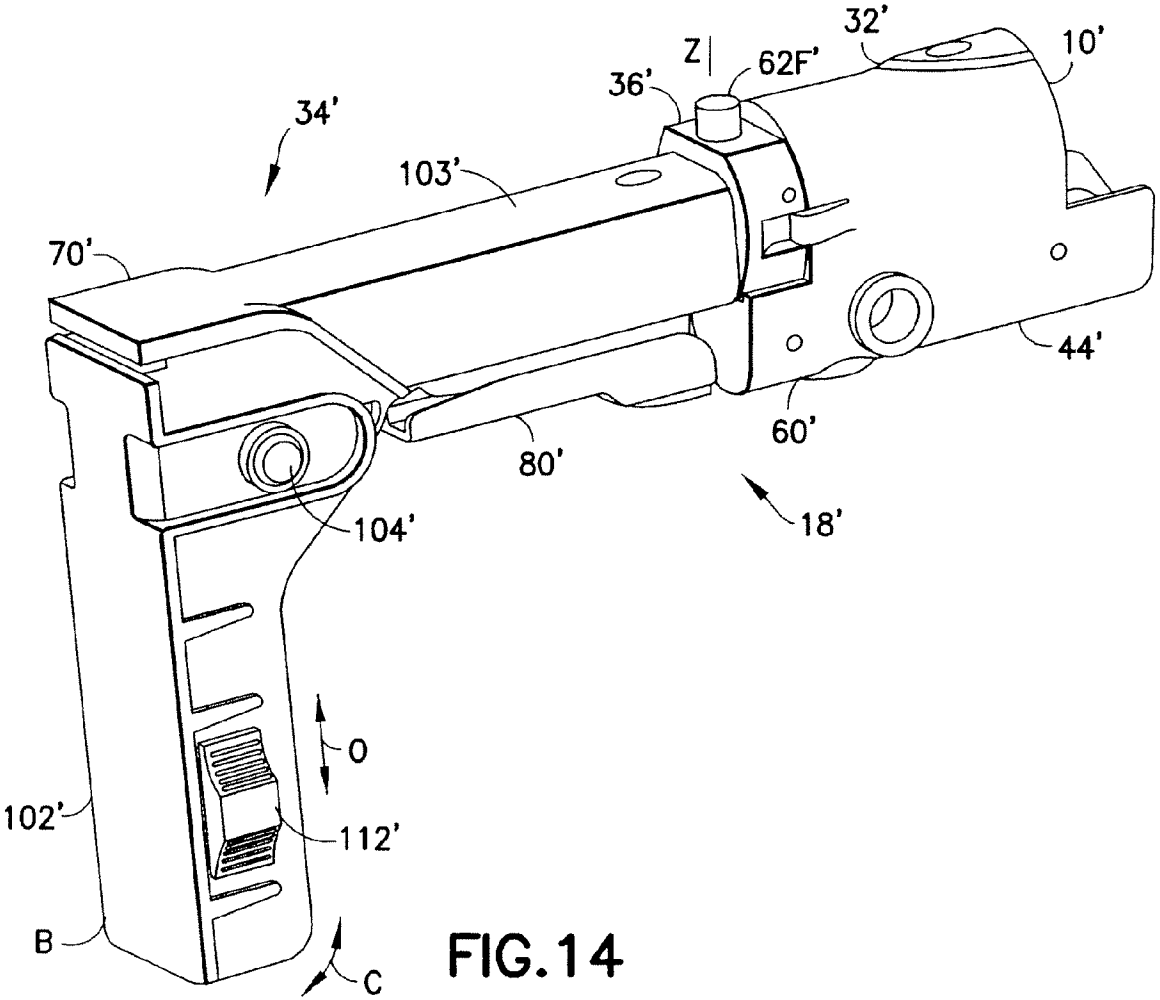
FIG. 14 is another partial isometric view of an end portion of the firearm.

As noted before, in the exemplary embodiment the folding portion 134 incorporates a telescoping system allowing the folding portion to have a selectably variable length (e.g. in either folded or deployed positions). In the exemplary embodiment folding portion 134 has a rotatable butt stock 170 capable of being rotated about extension tube 172 about axis 178. In FIG. 10, stock 170 is shown rotated to a position R' (e.g. the up position). may be generally opposed to the down (see for example FIG. 3). In alternate embodiments the stock may have any other desired orientation when in the up position. The butt stock may include a release 180 that may be spring loaded to a locked position. The release 180 (pivoting about pin 186) locks the telescoping position of butt stock 170 to extension tube 172 (see FIG. 10). For example pressing a rear portion, raises an engagement portion disengaging mating features (similar to slot 196) on extension tube 172 and allowing butt stock 170 to be moved relative to extension tube 172 (e.g. from a full back position, similar to positions E shown in FIG. 8) to a full forward position and may be rotated about axis 178, about 180 degrees between up and down positions. In the exemplary embodiment, extension tube 172 may have both longitudinal top and bottom guide grooves 192, 194 and engagement slots 196, 198 allowing longitudinal and rotational positioning of butt stock 170 relative to extension tube 172. Slots 194, 196 are provided on extension tube 172 intersecting grooves 192, 194 such as at about 90 degrees and allow butt stock assembly 170 to be incrementally located on extension tube 172 or pulled off extension tube 172. The butt stock may be located in either the up or down positions when the folding portion is in the unfolded position or in the folded position with the ability to rotate and lock in the up position. For example, as shown in FIG. 14, butt stock 170 may be rotated up and flipped open, such as for a left hand user allowing easy access to trigger, fire selector 126 or bolt carrier release 127 and can also be provided for a right hand user. For example, when butt stock 170 is rotated up, there is suitable access to the bolt release button and unobstructed access to the trigger from either left or right side. As described previously, stability detent 176 is provided on opposite side from hinge 160 and engages notch/guide 174 in hinge block 172 when the folding portion is in the unfolded position. As also noted before, in the embodiment shown, hinged portion 134 is spring biased (e.g. spring 160S) to the open position. The operator may thus easily operate the firearm with the stock in any position. As may be realized, any "blackrifle" may be configured in accordance with the exemplary embodiments as described above.

Figure 11:
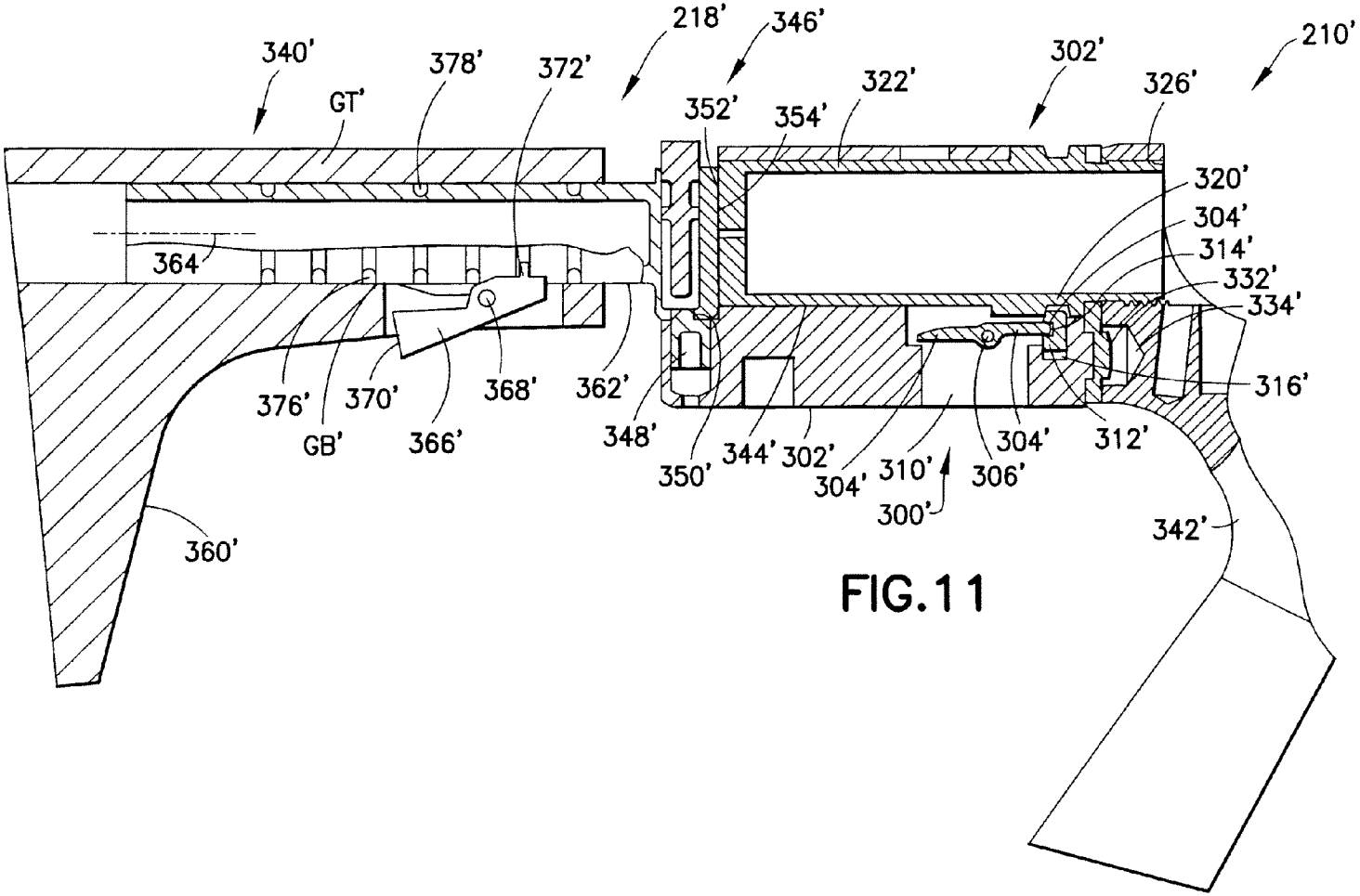
FIG. 11 is another section view of a folding stock of the firearm in accordance with another exemplary embodiment.

Referring now to FIG. 11, there is shown a section view of folding stock 218 in accordance with another exemplary embodiment. In the embodiment shown in FIGS. 11-13 folding stock 218, of a firearm 210, is disclosed having quick detach mechanism 300 for buttstock 218. The quick detach mechanism disclosed may be used with a folding buttstock or alternately with a telescoping, non-folding buttstock or a fixed buttstock. In the embodiment shown, the folding buttstock 218 is substantially similar to folding stock 18, 118 described previously but also has latch 300 included as shown. Extension tube 322 is substantially similar to extension tube 42 described before, except as otherwise noted. Referring also to FIG. 13, there is shown an isometric view of an exemplary latch 300. Latch 300 has latch lever 304 that pivots about pin 306 in housing 302. Latch 300 is encased inside of sleeve structure 302 to prevent inadvertent operator latch lever engagement, for example, during firing or handling of the firearm 210. In the exemplary embodiment, the latch lever is offset from the exterior of the sleeve and may be accessed through passage or recess 310 in the sleeve. To access the lever, an operator may use for example, a round or other elongated member in recess 310 of housing 302 to depress rear portion 304' of latch lever 304 to disengage tab 312 from receiver extension 322 allowing removal of buttstock 218. Referring again to FIG. 11, there is a shown section view of folding stock 218. Here, latch lever 304 has portion 304" that engages recess 314 in latch tab 312. Spring 316 keeps latch tab 312 engaged with groove 320 of extension tube 322. Tab 312 and groove 320 have mating slanted surfaces providing for a preloaded engagement of housing 302 against extension tube 322 where extension tube 322 is modified to provide an engagement groove 320 for the latch tab 312. The groove 320 and latch tab 312 have complementing camming surfaces that bias the sleeve 302 into the locked position against extension tube 322. Although latch 300 is shown as a tab and groove combination, any suitable latch mechanism may be provided. As may be realized, the quick detach allows the firearm to be used for example in a crew position, such as when vehicle borne and in the confines of the vehicle cabin by quickly detaching the stock 218, and then configured as a personal firearm, for example when the person dismounts by quickly attaching (e.g. snapping on) the stock 218. In the exemplary embodiment, the quick release 300 of the stock 218 may define is still another selector for selecting firearm configuration on the stock.

Figure 12:
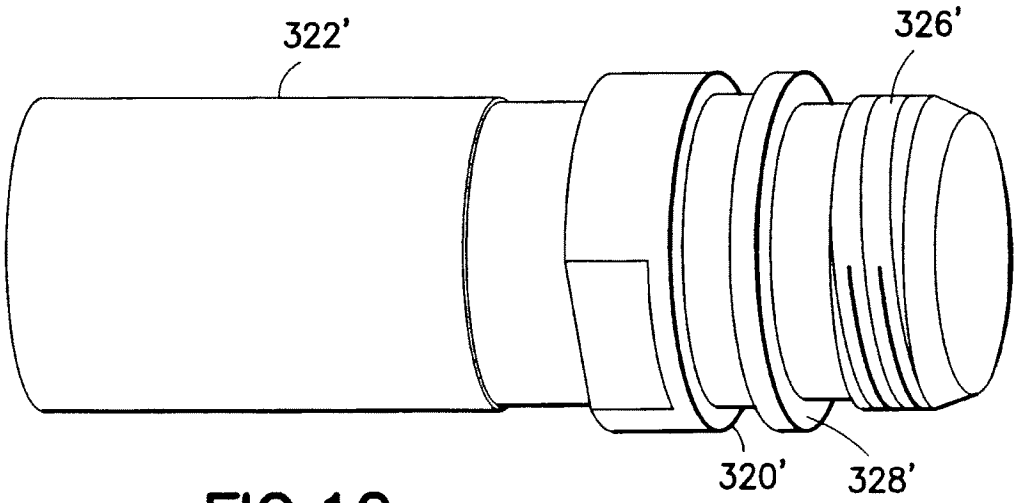
FIG. 12 is a isometric view of an extension member of the firearm.
Figure 13:
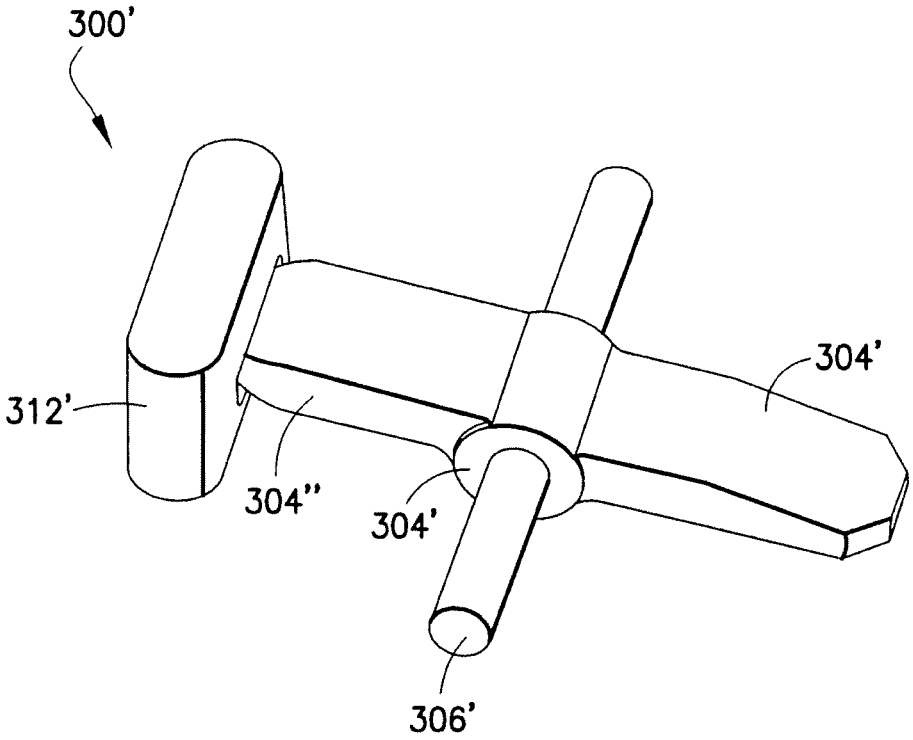
FIG. 13 is an isometric view of a latch of the firearm.

Referring also to FIG. 12, there is shown an isometric view of extension member 322. In the embodiment shown, extension tube 322 has threads 326 and face 328 that mate with receiver threaded rear bore 330 such that extension tube 322 directly engages the rear of the receiver (without a nut inside the receiver as in conventional arrangements). As seen in FIG. 11, in the exemplary embodiment, mating pin 332 on sleeve 302 also engages hole 334 in the receiver to prevent rotation of sleeve structure 302. In alternate embodiments, the extension member may be mounted to the receiver in any other desired manner. As noted before, the stock 218 in the exemplary embodiment shown in FIGS. 11-13, is illustrated as a folding stock with quick release 300 and also with a telescoping or extendable portion providing stock with selectably variable length similar to stock 18, 118 described before (and similar features are similarly numbered). Similar to what has been previously described, the base portion 302 of the stock 218, mates the stock to the lower receiver 342. The folding portion 340 may be joined to the base portion 302 by a coupling 346 that allows the folding portion 340 to be folded, or rotated relative to the base portion 302 from a deployed position or unfolded position to a folded or stowed position(s). The action system, similar to action system may be housed, at least in part, within the base portion 302 of the stock 218. As seen in FIG. 11, base 302 generally has a bore 344 formed therein allowing the base to be mounted to the receiver extension member or tube 322. The base 302 in the exemplary embodiment shown in the figures has a representative configuration and in alternate embodiments, the base may have any other desired arrangement. The base 302 may be made from any suitable material such as aluminum and may be of unitary construction. In alternate embodiments, the base may be formed as a multi piece member (i.e. instead of unitary construction, made of multiple components). In alternate embodiments, the base and lower receiver or extension tube may have interlocking detents with more than one selectable position allowing for example telescoping or rotational position between the receiver and base for a stock base of selectable variable length or rotational position. Coupling 346, may be similar to coupling 136 described before, and connects the end or folding portion 340 of the stock 218 to the base portion 302 and particularly in the exemplary embodiment, to the stock base 302. In alternate embodiments, the coupling may have any desired configuration. The coupling may also include a quick release allowing rapid removal and reinstallation of the folding stock portion 340 from the stock base 302. The configuration of the coupling 346 in the illustrated embodiments is merely exemplary, and in alternate embodiments the coupling may have any other suitable configuration. As seen in FIG. 11, interfacing seating surfaces 352, 354 on the folding portion 340 in the exemplary embodiment and stock base housing 302 may operate to fix the folding portion 340 to the base 302 when the folding portion is in its deployed position similar to coupling 36). When folding portion 340 is in the deployed position (shown in FIG. 11), in the exemplary embodiment, spring loaded detent 348 engages mating recess 350 to automatically lock the folding portion in its deployed (unfolded) position. As noted before, in the exemplary embodiment the folding portion 340 may incorporate a telescoping system allowing the folding portion to have a selectably variable length. The length of the folding portion may be adjusted/selected as desired with the folding portion in either the folded or deployed positions. In the exemplary embodiment folding portion 340 may have a rotatable butt stock 360 capable of being rotated about extension tube 362 about axis 364. The butt stock may include a release 366 that may be spring loaded to a locked position. The release 366 locks the position of butt stock 360 to extension tube 362. In the example shown, release 366 pivots about pin 368 and may be depressed on its rear portion 370 to overcome the spring load. Upon pressing rear portion 370, engagement portion 372 is raised, disengaging mating features on extension tube 362 and allowing butt stock 360 to be moved relative to extension tube 362. Butt stock 360 may be slid along extension tube 362 from a full back position to a full forward position and may be rotated about axis 364, about 180 degrees between up and down positions similar to butt stock 170 described previously. Extension tube 362 may have for example both longitudinal top and bottom guide grooves GT, GB (more or fewer grooves may be provided) and engagement slots 376, 378 allowing longitudinal and rotational positioning of butt stock 360 relative to extension tube 362. Here, the grooves in extension tube 362 may be located about 180 degrees apart, allowing 180 degree rotation of stock 360 about tube 362 where a mating feature on engagement portion 372 of spring loaded detent 366 engages the grooves GT, GB in the extension tube 362. Slots are provided on extension tube 362 intersecting grooves such as at about 90 degrees and allow butt stock assembly 360 to be incrementally located on extension tube 362 or pulled off extension tube 362.

Referring also to FIGS. 14-18, there are shown a partial perspective view and a side elevation view of a stock 18' of a firearm similar to firearms 10, 110, 210, in accordance with another exemplary embodiment. Referring also to FIGS. 19-23, there are shown side section views of stock 18'. Though illustrated for example purposes as articulated with three degrees of freedom (e.g. movable in directions indicated by arrows E, R, C in FIGS. 2, 3 and 14), in alternate embodiments the stock may be capable of articulation in more or fewer degrees of freedom. In the exemplary embodiment, stock 18' may have what may be generally referred to as a base portion 32' and folding portion 34'. The base portion 32' of the stock 18', mates the stock for example to the lower receiver 14. In the exemplary embodiment, the folding portion 34' may be joined to the base portion 32' by a coupling 36' that allows the folding portion 34' to be folded, or rotated relative to the base portion 32' from a deployed position (or unfolded position as illustrated in FIGS. 1-2 for example) to a folded or stowed position(s) (shown for example in FIGS. 3 and 10) as will be described further below. In the exemplary embodiment illustrated in the figures, the folding portion is shown for example folded on the left side of the firearm. In alternate embodiments, the folding portion of the stock may have more than one folded position. For example the folded portion of the stock may be folded down or on the right side of the firearm. In other alternate embodiments, the folding portion may be moved to any other desired folded position.

As noted before, firearm 10' (only a portion of which is shown in FIG. 10) may be substantially similar to firearms 10, 110 and 210 described previously (and similar features may be similarly numbered). An action system may be housed, at least in part, within the base portion 32' of the stock 18'. The stock base portion 32', connecting the stock 18' to the rear end of the lower receiver houses a receiver extension member within a stock base housing 44'. In alternate embodiments, the base portion may have any other desired configuration. In the exemplary embodiment, the receiver extension member may have a generally hollow cylindrical shape and may be sized and shaped to house and allow desired movement of the bolt carrier action system and bolt carrier as the bolt carrier is cycled during operation of the firearm (e.g. see FIGS. 4, 9 and 12). In alternate embodiments, the receiver extension member may have any other desired shape or features. Base 44' may have a bore or receptacle formed therein allowing the base to be mounted to the receiver extension 42 (for example similar to base 302, see FIG. 11). In the exemplary embodiment, the base forms a mounting interface or bracket for mounting the base housing 44' of the stock 18' to the receiver extension 42' and hence, the firearm. The base 44' in the exemplary embodiment shown in the figures has a representative configuration and in alternate embodiments, the base may have any other desired arrangement. The base may be made from any suitable material such as aluminum or suitable non-metallic material (e.g. plastic) and may be of unitary construction. In the exemplary embodiment the base 44' may be removably locked to the receiver extension 42' for example, by a quick release/detach mechanism (similar for example to mechanism 300 shown in FIG. 11) such as a spring loaded latch engaging a detent on the receiver extension, or any other desired position fixing devices/features (e.g. a take down pin). In the exemplary embodiment, the base may have a recess generally conforming to a locking ring on the receiver extension. In the exemplary embodiment, the base may have locating features (e.g. detents) to positionally locate the base with respect to the firearm receiver. As noted before, the stock base 44 may have a suitable interior passage or opening, for example conforming to the shape of the receiver extension, and allowing the stock base 44' to be mounted to the extension for example by sliding the stock base over the extension. The base 44' and extension member or lower receiver may be provided with suitable interlocking detents (e.g. lock pin and receptacle) to fix the base to the receiver. The interlocking detents may be spring loaded for automatic engagement. In alternate embodiments, any suitable fastening technique may be used. In alternate embodiments, the base may be formed as a multi piece member (i.e. instead of unitary construction, made of multiple components). In alternate embodiments, the base and lower receiver or extension may have interlocking detents with more than one selectable position allowing for example telescoping or rotational position between the receiver and base for a stock base of selectable variable length or rotational position. As noted before the shape of the stock base housing 44 in the illustrated embodiments is merely exemplary, and in alternate embodiments the stock base housing may have any other suitable shape.

Coupling 36' connects the end or folding portion 34' of the stock 18' to the base portion 32' and particularly in the exemplary embodiment, to the stock base 44'. In the exemplary embodiment, coupling 36' incorporates a single degree of freedom, for example, a single axis of rotation (similar to axis R in FIG. 5). In alternate embodiments, the coupling may have multiple degrees of freedom (e.g. multiple axis of rotation allowing the folding portion to be rotated to either side and/or rotated vertically). The coupling may also include a quick release allowing rapid removal and reinstallation of the end stock portion 34' from the stock base 32'. The configuration of the coupling 36' in the illustrated embodiments is merely exemplary, and in alternate embodiments the coupling may have any other suitable configuration. In the exemplary embodiment, the coupling 36' may have a hinge 60' located to allow the folding portion to be rotated to the left side. In the exemplary embodiment, the folding portion 34' may be spring loaded in the folded position (e.g. similar to that shown in FIG. 2). The spring may be configured as desired to generate sufficient bias to hold the folding portion 34' in the folded position throughout any desired operation of the firearm. In alternate embodiments, other hinge locations may be provided, for example, a center or left hand hinge location. In alternate embodiments, a spring loaded detent may be provided on base portion 32' with a mating portion on folding portion 34' to hold the folding portion 32' in the folded position. Spring loaded detents (similar to detents 62P, 62A in FIG. 3) engage automatically to lock the folding portion in its unfolded position. Push pin 62F' (see FIG. 14) is provided in the exemplary embodiment to disengage the detents and unlock the folding portion from its unfolded or deployed position. The arrangement of the spring loaded detents and push pin is merely exemplary. The push pin 62F' may be pressed in the direction indicated by arrow Z (in FIG. 14) pushing the push pin to engage detent. As may be realized, the push pin deflects the detent causing it to disengage the folding portion and allowing folding stock portion 32' to be released. Interfacing seating surfaces (e.g. similar to surfaces 74, 76, see FIG. 3) on the folding portion 34' in the exemplary embodiment and stock base housing 44' fix the folding portion 34' to the base 44' when the folding portion is in its deployed position. For example, when folding portion 34' is in the deployed position, protrusion similar to protrusion 76 is seated within mating a slot similar to slot 74 and providing additional structural support. In alternate embodiments, interfacing surfaces between folding portions 34' and base 44' may be provided in any desired arrangement for stably holding and positioning the folding portion when in the unfolded position.

As noted before, in the exemplary embodiment the folding portion 34' incorporates a telescoping system allowing the folding portion to have a selectably variable length. The length of the folding portion may be adjusted/selected as desired with the folding portion in either the folded or deployed positions. In alternate embodiments, the folding portion may have a rotatable butt stock capable of being rotated about extension tube axis (similar to axis 78 shown in FIG. 3) between a down position (similar to that shown in FIG. 3) and an up position (similar to that shown in FIG. 10) substantially opposite to the down position. In the exemplary embodiment shown, stock 70' though capable of movement along axis 78', (direction indicated by arrow E in FIG. 2), may be rotationally fixed about axis 78' in a position that for convenience may be referred to as the down position. In alternate embodiments the stock may have any other desired orientation. The butt stock may include a release 80' (see also FIG. 18) that may be spring loaded to a locked position. The release 80' in the exemplary embodiment, may lock the telescoping or extending position of butt stock 70' to extension post or member 72'. In the example shown, release 80' pivots about portion 86' and may be depressed on its rear portion 88', for example by compression of butt portion 102' to overcome the spring load (see FIGS. 16 and 22) of spring loaded engagement portion 90' that engages slot 96'. A user may also depress rear portion 89' of release 80' to directly release the position of stock 70' relative to extension 72'. In the exemplary embodiment, upon pressing rear portion 88', engagement portion 90' is raised, disengaging mating features (similar to slot 96') on extension 72 and allowing butt stock 70' to be moved relative to extension 72'. Here, butt stock 70' may be slid along extension 72' from a full back position to a full forward position and vice versa extending or collapsing the buttstock 70'. Extension 72' may have longitudinal guide grooves and engagement slots 96' (located as desired, see for example FIG. 19) allowing longitudinal positioning of butt stock 70' relative to extension 72'. In alternate embodiments, the multiple longitudinal may be provided grooves in extension member located about its periphery and, allowing rotation of stock about the member (in a manner similar to that previously described). In other alternate embodiments, more than two rotational positions or different rotational angles could be provided. In alternate embodiments, a detent may be provided in extension 72' and vice versa. Buttstock 70' may also be removed from (e.g. pulled off) extension 72'. As will be described in greater detail below, suitable features are provided to latch or release 80' that may engage slots 96', 98' allowing the buttstock 70' to be locked in a selected telescoping position allowing incremental positioning of stock assembly 70'. Along extension 72' The folding portion 34' in the exemplary embodiment may be shaped so that the operating mode selector 26, 126 (see FIGS. 1, 10) is readily accessible by the operator when the folding portion 34' is in its folded position and telescoped in (i.e. min. length). The operator may thus easily operate the firearm with the stock in any position. As may be realized, any M4™ rifle may be configured in accordance with the exemplary embodiments as described above by replacing the conventional bolt carrier, action system and stock with the bolt carrier, action system and stock 18' of the exemplary embodiment.

Figure 15:
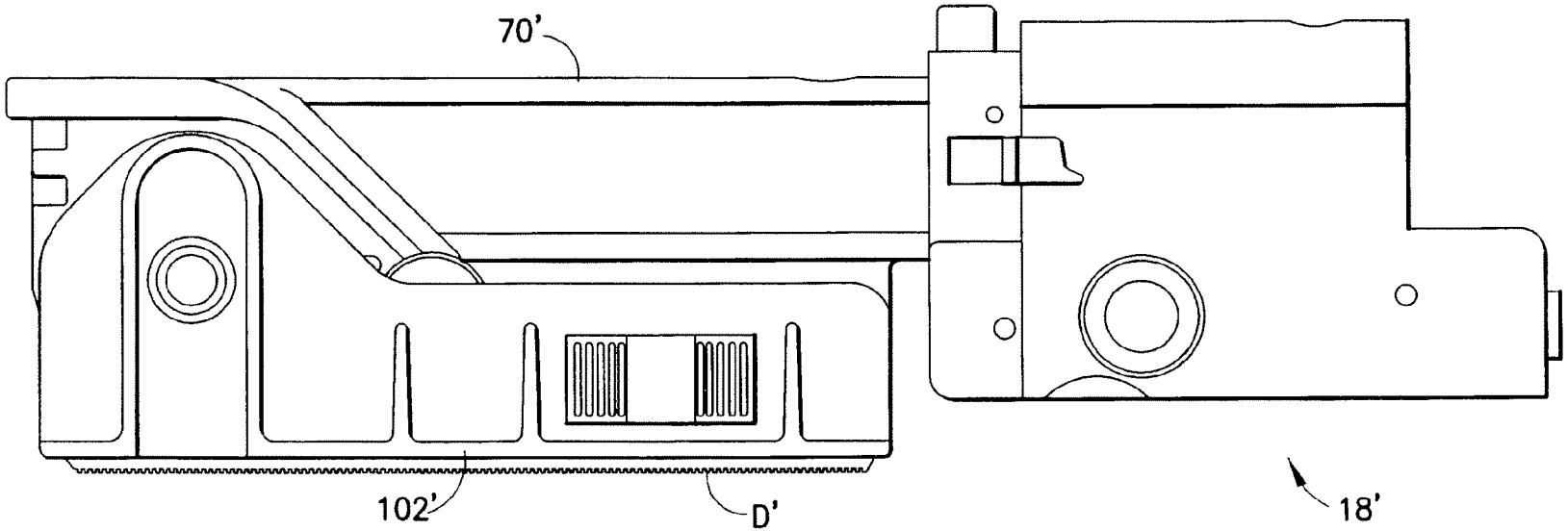
FIG. 15 is a partial side elevation view of the end portion in a different position.
Figure 16:
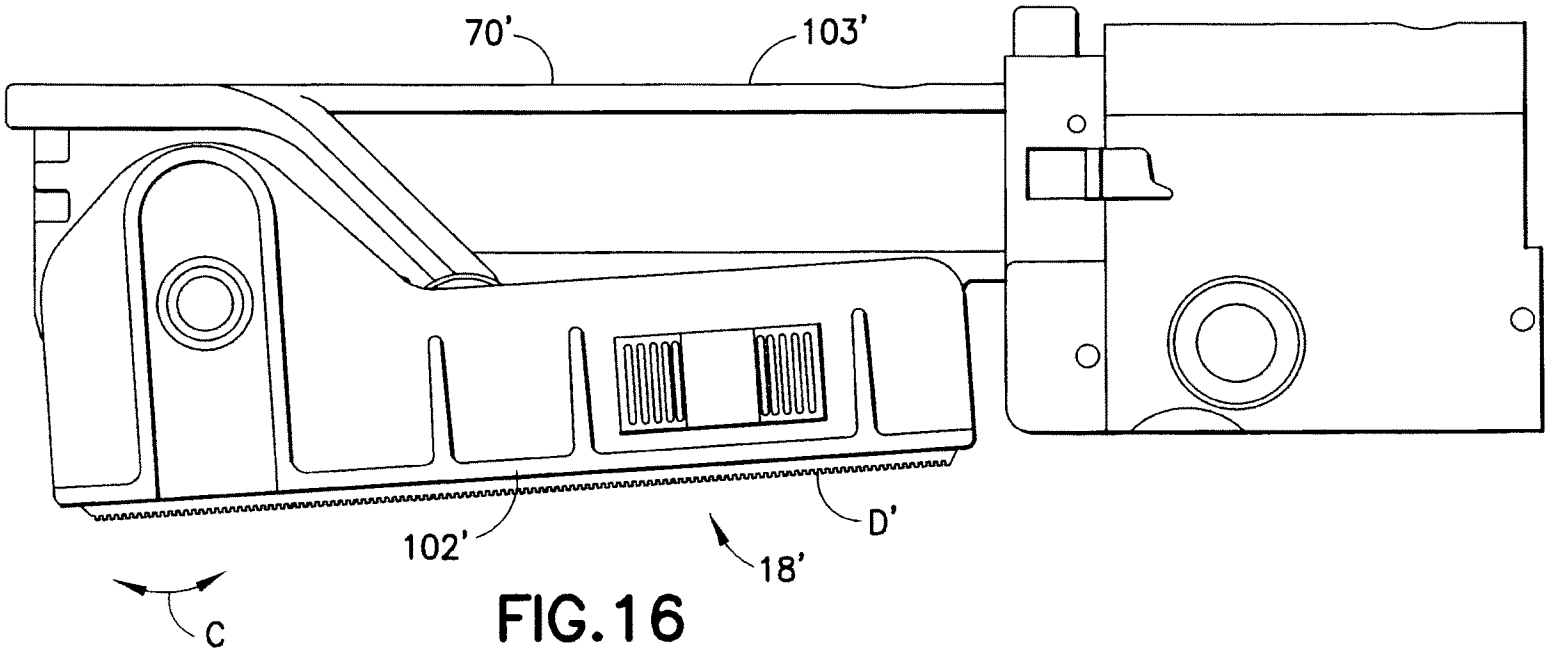
FIG. 16 is another partial side elevation view of the end portion in another different position.
Figure 17:
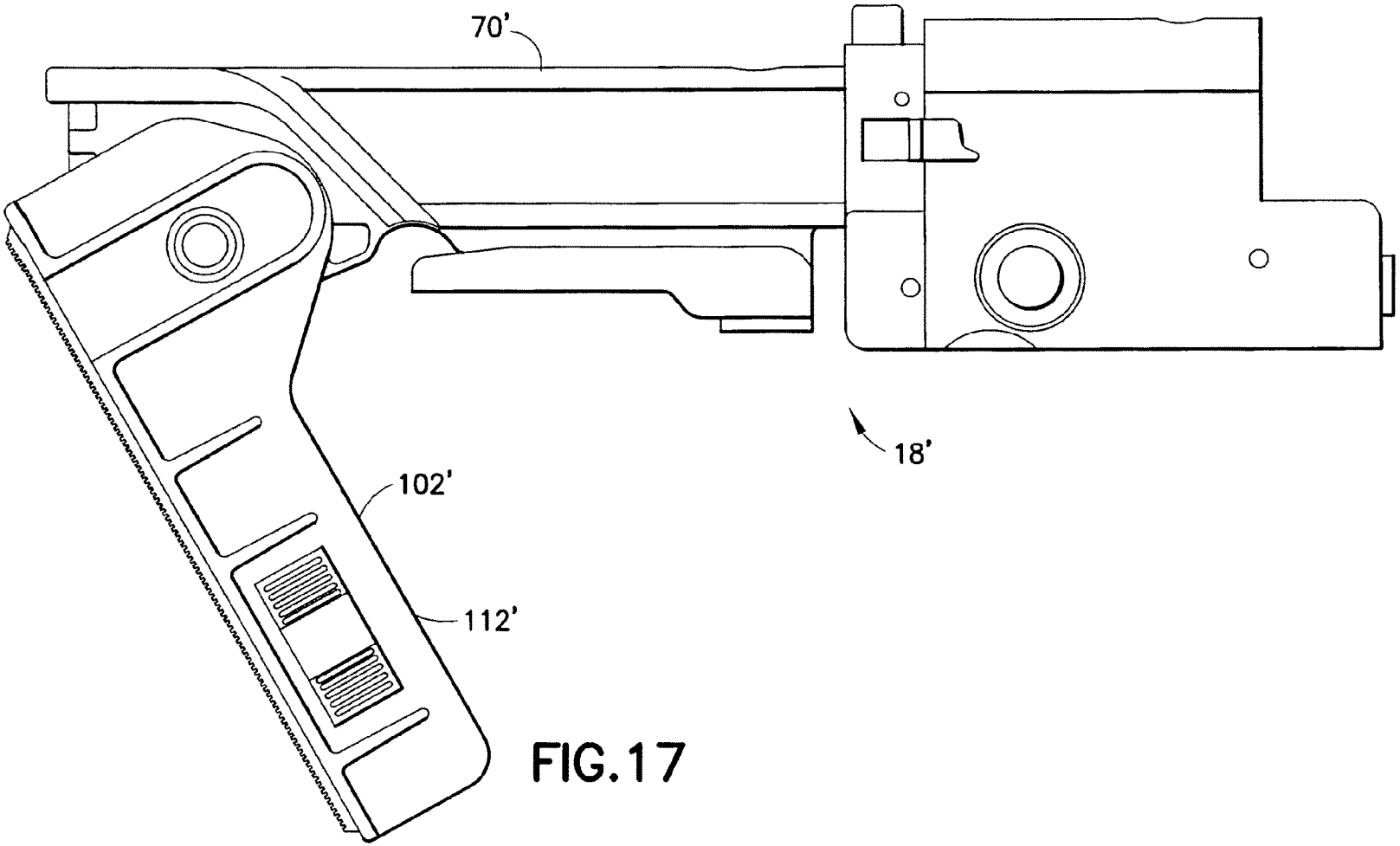
FIG. 17 is another partial side elevation view of the end portion shown in yet another position.
Figure 18:
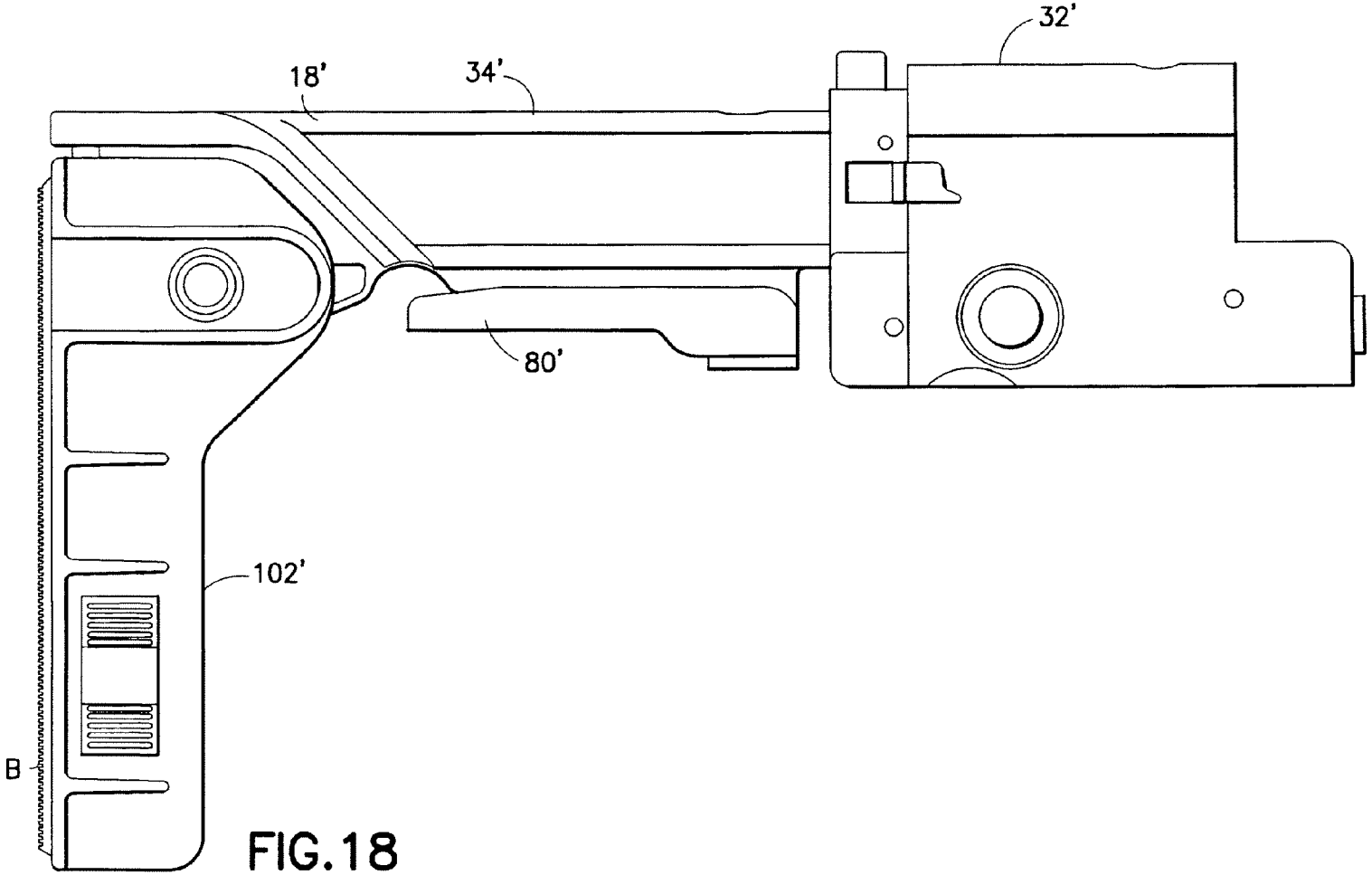
FIG. 18 is another partial side elevation view of the end portion shown in yet another position.
Figure 19:
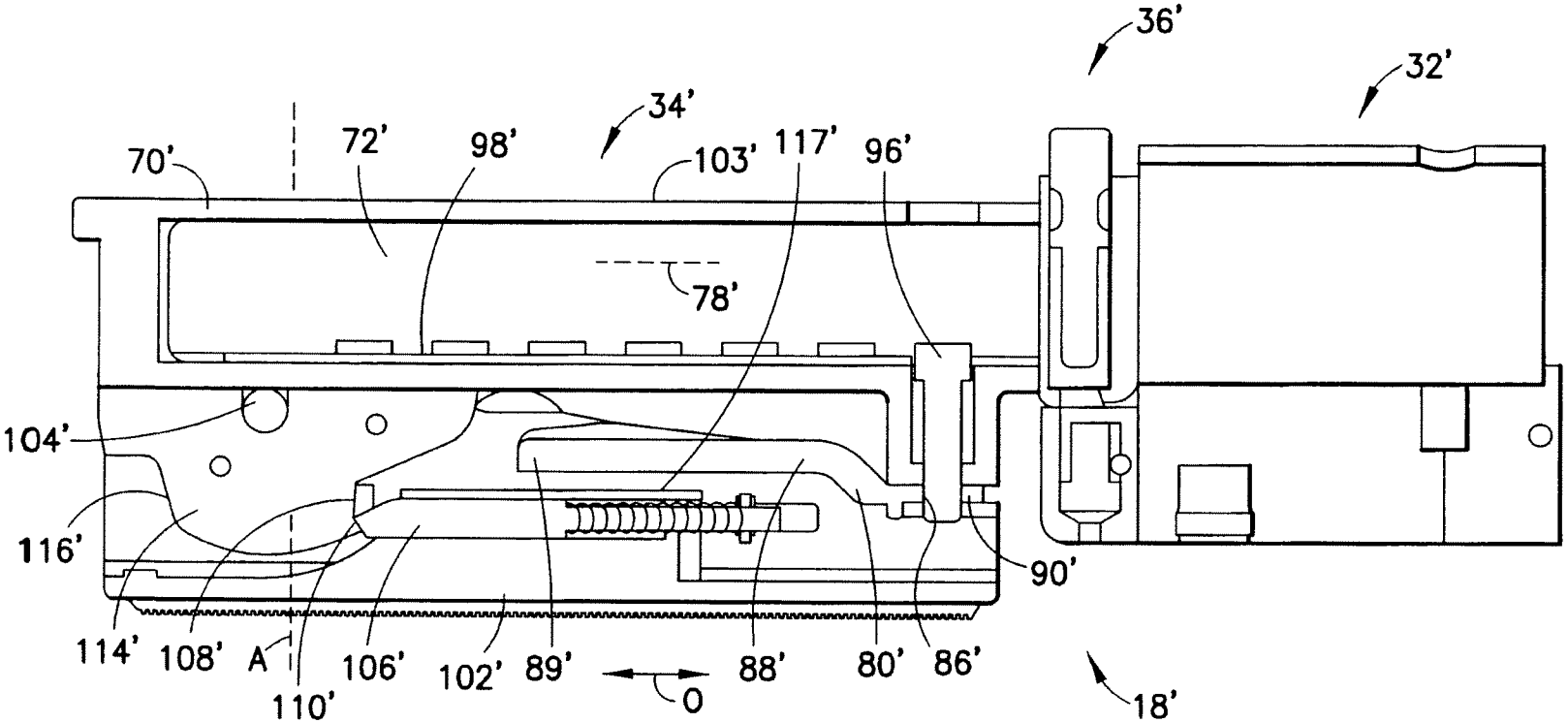
FIG. 19 is a side section view of the end portion shown in one position.

Although the disclosed embodiment is shown with hinge 60' and slideable buttstock 70', in alternate embodiments, as noted before, these features may or may not be provided in any suitable combination. As also noted before, in other alternate embodiments, still other features may be provided to the buttstock such as allowing stock rotation about the extension tube. Further, the features of the disclosed embodiments may be used with either a folding or non-folding stock. As noted before, portion 34' may have stock portion 70' and butt portion 102'. In the exemplary embodiment shown in FIG. 14, butt portion 102' comprises a movable, for example hinged and/or clamshell back such that butt portion 102' may be moved relative to stock portion 103' on the extension member 72', from a deployed position B (see FIGS. 14, 18 and 23) to a folded position D (see FIGS. 15 and 19). In the exemplary embodiment, butt portion 102' may be hinged (such at pin 104') to allow movement (such as in the direction indicated by arrow C) and fold under butt sleeve 103'. In alternate embodiments the butt portion may be movably connected to the sleeve in any other suitable manner to allow movement between butt portion and sleeve so that the butt may be deployed or folded or collapsed. As previously described, butt portion 102' may be movable (in the direction of arrow C) from the folded position D shown in FIG. 15 to a position D1, to engage release 80' allowing detent 90' in the hollow channel to disengage the lock housed inside the channel (see FIGS. 16 and 22). As shown in FIGS. 15 and 16, butt portion 102' when closed (e.g. positions D, D1) may cover the longitudinal latch 80' of butt 70'. Here, with butt portion 102' closed, back portion 34' is movable when butt portion 102' is squeezed or pressed relative to portion 103' (moving from closed position D, in which the butt portion 102' does not engage release 80' as shown in FIG. 19 to position D1 shown in FIG. 16) causing release 80' to disengage the longitudinal latch and allow longitudinal movement of sleeve 70' on post 72' for extension and/or retraction.

Figure 20:
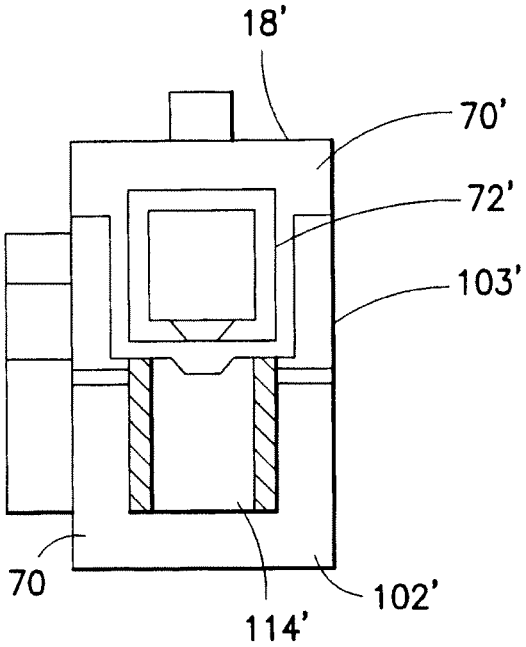
FIG. 20 is a section view of the end portion taken along line A-A in FIG. 25.
Figure 21:
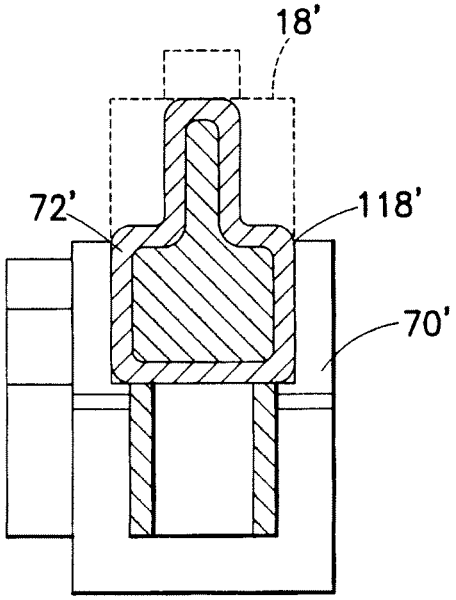
FIG. 21 is another section view of the end portion in accordance with another exemplary embodiment.
Figure 22:
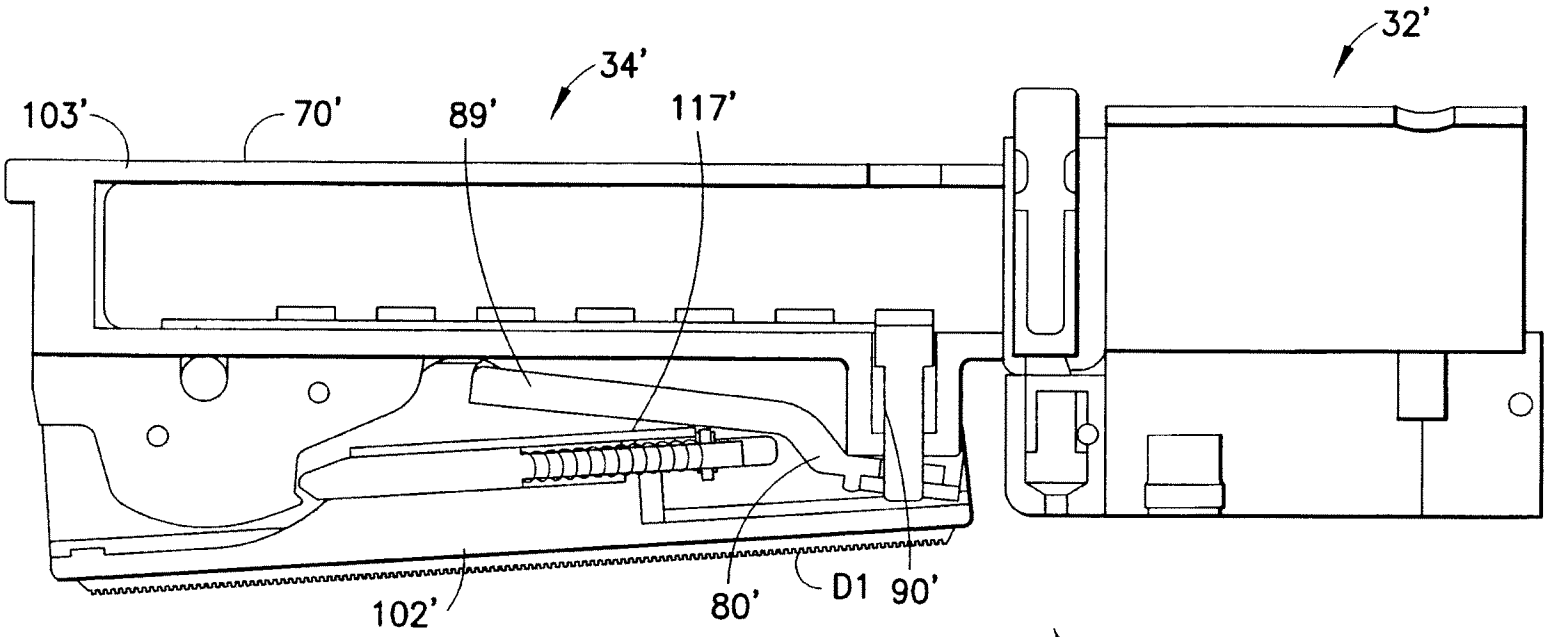
FIG. 22 is another partial side section view of the end portion shown in still another position.

In the exemplary embodiment shown in FIG. 19, when the butt portion 102' is in position D, spring loaded plunger 106' (described in greater detail below) may operate on cam surface 108' to bias butt portion 102 back to the folded position D shown in FIG. 15. Also, the closed plunger 106' seats into groove 110' cammed to bias butt portion 102' into the closed position and prevent undesired opening. The locking plunger 106' may be moved by actuator 112' such slide tabs (moved in the direction indicated by arrow O in FIG. 19) and may be actuated with slide 112' to unlock butt portion 102' by disengaging portion 110' allowing the butt portion to rotate from the closed position to the deployed position 13 (see FIG. 14). In the deployed position B (shown in FIGS. 14, 18 and 23), plunger 106' may engage rear portion 116' of block 114' to lock butt portion 102' in the deployed position. Similarly, slide tabs 112' may be engaged to release butt portion 102' from the deployed position. In the exemplary embodiment a locking recess 116' in block 114' mounted for example to sleeve 103' (or integrally formed in the sleeve structure) receives plunger 106' to hold butt portion 102' back in the open or deployed position B until actuator 112' is operated to disengage plunger from recess. Additionally, there is sufficient plunger and recess engagement to prevent closure of butt portion 102' in the event firearm 10' is inadvertently dropped and strikes butt first. In the exemplary embodiment the elements, such as extension post 72', and stock 70' (such as butt portion 102' and/or sleeve portion 103' (forming assembly 34') may be made from plastic or glass-fiber plastic (20-50% glass filled). In alternate embodiments, any suitable material may be used to fabricate one or more of the elements. In the embodiment shown, back plate or butt portion 102' may lock to position at an about 85 degree angle relative to axis 78' leaving about 5 degrees from vertical nominally. In alternate embodiments, any suitable angle or shapes may be used. Referring also to FIG. 20, there is shown another sectional view of portion 34' taken along line A in FIG. 19. In the embodiment shown, sleeve 103' may comprise a one piece sleeve casing and may be manufactured, for example with a metallic mounting block and latch 114' molded integral with sleeve portion 70'. The shape of the sleeve 103', as well as extension post 72' to which the sleeve is substantially conformal, is merely representative and in alternate embodiments both sleeve and post may have any desired shape. The sleeve 103' may include a closed tube cross section which as shown, complements the shape of post 72' (which may also have a tube shape), for positional stability, and allows for high strength and rigidity with thin section walls. Suitable interface or lapping sections lap the mounting block 114' allowing the block to be integrated into the sleeve when the sleeve is molded, such as in a thermal press or injection mold or any other suitable process. In the exemplary embodiment, latch plate 114' may be aluminum or any suitable material and shaped for holding butt portion 102' with pin 104'. In alternate embodiments, any suitable materials, separate or integrally molding combinations may be provided. As noted before, in other alternate embodiments, the sleeve and extension post portion may be round. However, in the embodiment shown in FIG. 14, sleeve 70' and post 72' cross sections are shown as substantially rectangular in section preventing rotation of portion 70' relative to portion 72' when released. In alternate embodiments, any suitable shapes may be used, for example, an embodiment having a general inverted "T" cross-section with mating T flange 118' on the bottom or any other suitable shape may be provided (see FIG. 21) or having a general "L" shaped cross-section.

Figure 23:
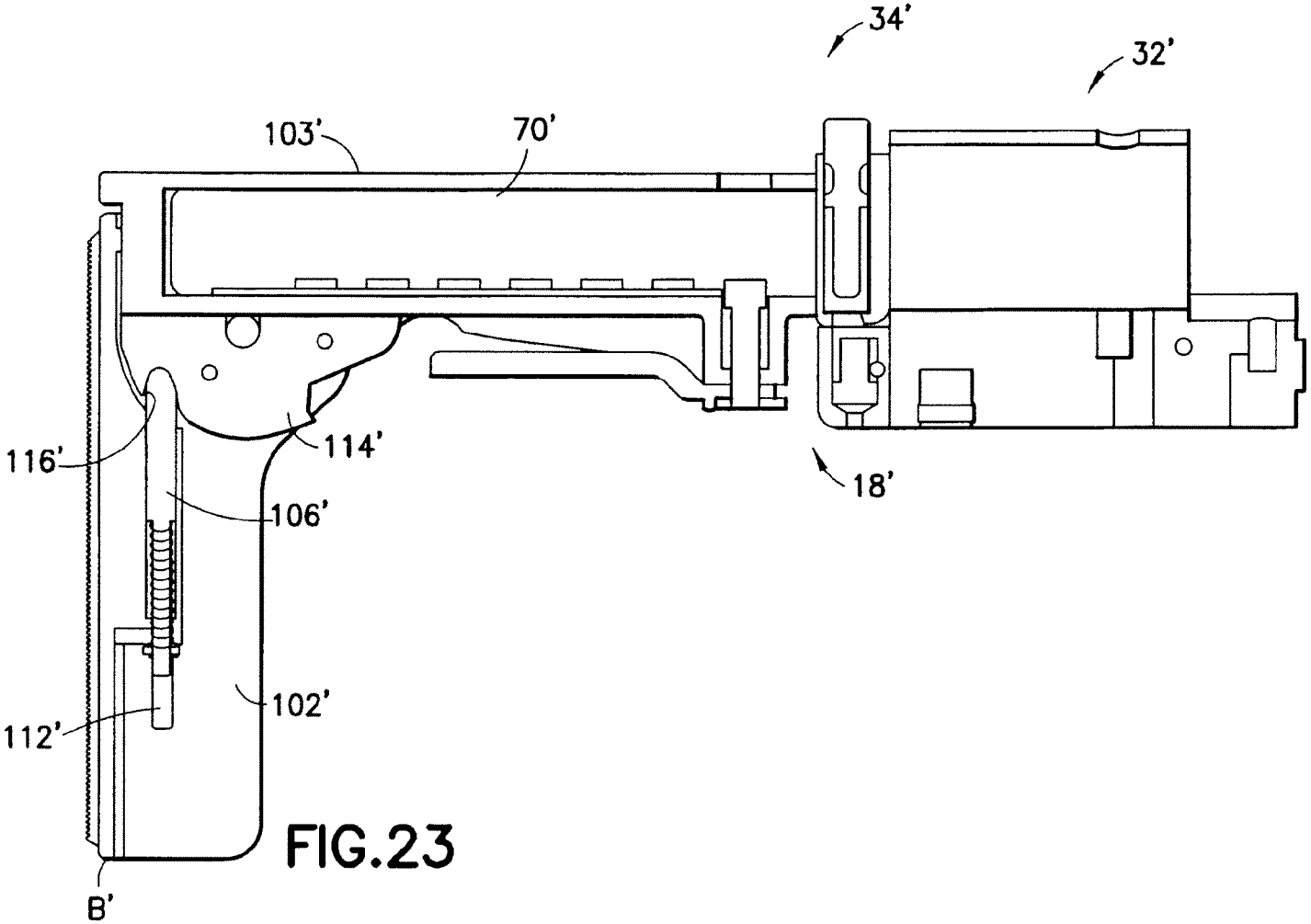
FIG. 23 is another partial side section view of the end portion shown in still another position.

Butt portion 102' may have any suitable shape. In the exemplary embodiments, the butt portion 102' may form a general clevis shape to effect hinge engagement with the mounting block 114' (see for example FIG. 20). As may be realized, the exterior surface of butt portion may define the butt surface of the firearm 10', when the portion is opened to the deployed position B shown in FIGS. 14 and 18. Referring now to FIG. 23, in the exemplary embodiment, plunger 106', which may be made of any suitable material such as steel, is movably mounted on butt portion providing, as noted before in cooperation with the block 114', the latch for locking the butt portion in its deployed or open position B, or biasing it in its folded position. The plunger action is spring loaded. The plunger 106 may be moved by actuator 112' (the actuator may be moved in the direction indicted by arrow O in FIG. 14) to disengage recess 116' and unlock the butt portion from the open position B to be moved to its collapsed or closed position D (see FIGS. 15 and 19). As, noted before, engagement between plunger 106' and cam 110' biases the butt portion in its closed position D, but camming action may be overcome by the operator holding and moving the butt portion (in direction indicated by arrow C) to the deployed position, without for example actuating plunger 106' via tabs 112'. As noted before, in the exemplary embodiment the folding portion 34' incorporates a telescoping system allowing the folding portion to have a selectably variable length. The length of the folding portion may be adjusted/selected as desired with the folding portion in either the folded or deployed positions. The folding portion 34' may be configured with butt portion 102' closed (e.g. position D). As seen best in FIG. 19, in the exemplary embodiment, the butt portion 102' may have an engagement surface 117' located to engage and press actuation portion 89' of latch 80'. Surface 117' may be located on butt portion 102' so that when the butt portion 102' is in closed position D., the engagement surface 117' does not contact actuation portion 89' of the latch 80'. Camming action between spring loaded detent 106' and cam surface 108' maintains the surface 117' from inadvertent contact with portion 89'. As noted before, in the exemplary embodiment, the user may overcome the camping action by rotating the butt portion 102' in the direction of arrow C (see FIG. 14) to position d1 (see also FIG. 22) causing the latch engagement surface 117 to contact and engage latch portion 89' thereby opening the latch 80'. In the exemplary embodiment, the configuration of the butt portion 102', latch 80' and the connection to sleeve 103', allows the user to move the butt portion 102' to open the latch 80' (hence releasing the buttstock 70' to be extended or collapsed) by pressing the butt portion 102' towards sleeve 103' or by squeezing butt portions 102' and 103' together. The operator may thus easily operate the firearm with the stock in any position. As may be realized, any block rifle may be configured in accordance with the exemplary embodiments as described above by replacing the conventional bolt carrier, action system and stock with the bolt carrier, action system and stock 18' of the exemplary embodiment.

Figure 24:
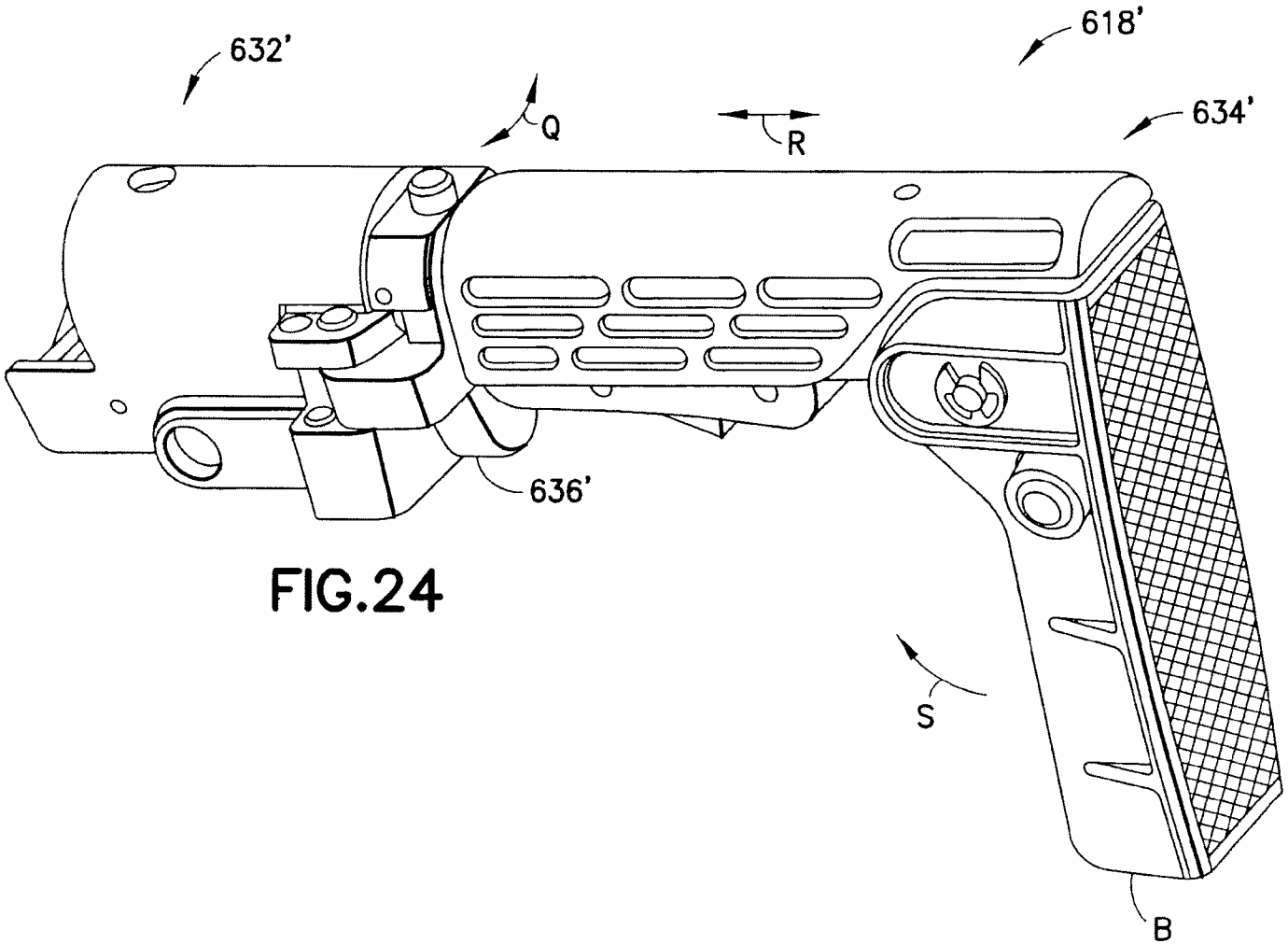
FIG. 24 is another partial isometric view of the firearm.
Figure 25:
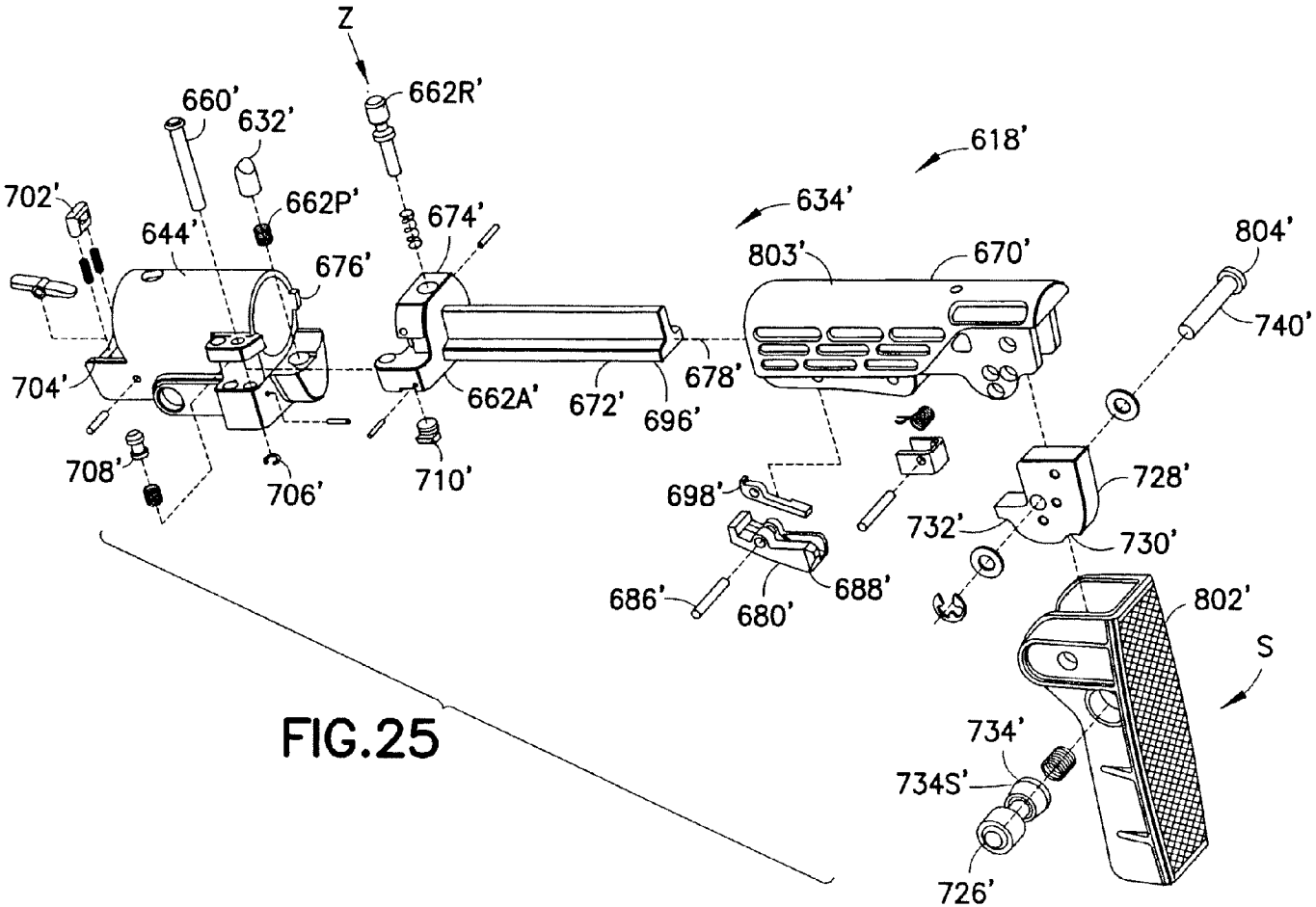
FIG. 25 is an exploded view of a rear portion of the firearm.

Referring now to FIG. 24, there is shown an isometric view of another exemplary embodiment butt stock 618. Referring also to FIG. 25, there is shown an exploded view of butt stock 618. Though illustrated for example purposes as articulated with three degrees of freedom; movable in directions indicated by arrows Q, R, S, in alternate embodiments the stock may be capable of articulation in more or fewer degrees of freedom. In the exemplary embodiment, stock 618 may be similar to stock 18' described before and may have what may be generally referred to as a base portion 632 and folding portion 634. The base portion 632 of the stock 618, mates the stock for example to the lower receiver 14 (see FIGS. 1-2). In the exemplary embodiment, the folding portion may be joined to the base portion by a coupling 636 that allows the folding portion to be folded, or rotated relative to the base portion from a deployed position. An action system may be housed, at least in part, within the base portion 632. The base 644 may be removably mounted to the receiver extension for example, by a spring loaded latch 702 engaging a detent on the receiver extension, or any other desired position fixing devices/features. In the exemplary embodiment the base may have a recess generally conforming to a locking ring on the receiver extension. In the exemplary embodiment, the base may have locating features (e.g. detents) to positionably locate the base with respect to the firearm receiver. The base 644 and extension or lower receiver may be provided with suitable interlocking detents 702, 704 (e.g. lock and receptacle) to fix the base to the receiver. The interlocking detents may be spring loaded for automatic engagement. In alternate embodiments, any suitable fastening technique may be used. In alternate embodiments, the base and lower receiver or extension may have interlocking detents with more than one selectable position allowing for example telescoping or rotational position between the receiver and base for a stock base of selectable variable length or rotational position. Coupling 636 connects the end or folding portion 634 of the stock 618 to the base portion 632 (in the exemplary embodiment, to the stock base 644). In the exemplary embodiment, coupling 636 incorporates a single degree of freedom, for example, a single axis of rotation. In alternate embodiments, the coupling may have multiple degrees of freedom (e.g. multiple axis of rotation allowing the folding portion to be rotated to either side and/or rotated vertically). The coupling may also include a quick release allowing rapid removal and reinstallation of the folding stock portion 634 from the stock base 632. The configuration of the coupling 636 in the illustrated embodiments is merely exemplary, and in alternate embodiments the coupling may have any other suitable configuration. In the exemplary embodiment, the coupling 636 may have a hinge 660 located to allow the folding portion to be rotated to the left side. Circlip 706 retains pin 660. In the exemplary embodiment, the folding portion 634 may be spring loaded in the folding position. The spring may be configured as desired to generate sufficient bias to hold the folding portion 634 in the folded position throughout any desired operation of the firearm. In alternate embodiments, other hinge locations may be provided, for example, a center or left hand hinge location. Spring loaded detent 708 may be provided, for example on base portion 632 with a mating portion 710 on folding portion 634, to hold the folding portion 634 in the folded position. Mating portion 710 may be a different material allowing for wear. Spring loaded detents 662P, 662A engage automatically to lock the folding portion in its unfolded position. Push pin 662F is provided in the exemplary embodiment to disengage the detents and unlock the folding portion from its unfolded or deployed position. The arrangement of the spring loaded detents and push pin is merely exemplary. The push pin 662F may be pressed in the direction indicated by arrow Z pushing the push pin to engage detent 662P. As may be realized, the push pin deflects the detent causing it to disengage the folding portion and allowing folding stock portion 632 to be released. Interfacing seating surfaces 674, 676 on the folding portion 634 in the exemplary embodiment and stock base housing 644 fix the folding portion 634 to the base 644 when the folding portion is in its deployed position. When folding portion 634 is in the deployed position, protrusion 676 is seated within mating slot 674 and providing additional structural support. In alternate embodiments, interfacing surfaces between folding portions 634 and base 644 may be provided in any desired arrangement for stably holding and positioning the folding portion when in the unfolded position.

In the exemplary embodiment folding portion 634 incorporates a telescoping system allowing the folding portion to have a selectably variable length. The length of the folding portion may be adjusted/selected as desired with the folding portion in either the folded or deployed positions. In alternate embodiments, the folding portion may have a rotatable butt stock capable of being rotated about extension tube axis between a down position and an up position substantially opposite to the down position. In the exemplary embodiment shown, stock 670 though capable of movement along axis 678, may be rotationally fixed about axis 678 in a position that for convenience may be referred to as the down position. In alternate embodiments the stock may have any other desired orientation. The butt stock may include a release 680 that may be spring loaded to a locked position. The release 680 locks the position of butt stock 670 to extension tube 672. In the example shown, release 680 pivots about portion 686 and may be depressed on its rear portion 688 by compression of butt portion 802 (towards sleeve 803) to overcome the spring load of spring loaded engagement portion 690 that engages slot 696. Alternately, a user may depress rear portion of release 680 to release the position of stock 670 relative to extension tube 672. Upon pressing rear portion 688, engagement portion 690 is raised, disengaging mating features on extension tube 672 and allowing butt stock 670 to be moved relative to extension tube 672. Here, butt stock 670 may be slid along extension tube 672 from a full back position to a full forward position. Portion 634 may have stock sleeve portion 803 and butt portion 802. Butt portion 802 comprises a movable, for example hinged and/or clamshell back and is hinged about pin 804 such that butt portion 802 may be in a deployed position B (see FIGS. 20, 25) or in a folded position (Similar to positions D, D1 in FIGS. 15, 16). In the exemplary embodiment, butt portion 802 may be hinged (such at pin 804) to allow movement (such as in the direction indicated by arrow S) and fold under butt sleeve 803. In alternate embodiments the butt portion may be movably connected to the sleeve in any other suitable manner to allow movement between butt portion and sleeve so that the butt may be deployed or folded or collapsed. Butt portion 802 when closed may cover the longitudinal latch 680 of buttstock 670. Here, with portion 802 closed, back portion 634 is movable when butt portion 802 is squeezed or pressed relative to portion 803 allowing release 680 to disengage (recess or slots 696 of) posts 672 and allow longitudinal movement of back portion 634 on post 672 for extension and/or retraction. Spring loaded latch 726 (e.g. a plunger positioned across the butt portion 802 as shown in FIG. 25) is retained and spring loaded in butt portion 802. Mating portion 728 is mounted within sleeve 670 and has mating features 730, 732 which mate with corresponding shoulder 734 of plunger 726 and lock butt portion 802 respectively in positions B, D. Plunger 726 is shown recessed within butt portion 802. When plunger 726 is depressed, shoulder 734 disengages the mating portion allowing butt portion 802 to be rotated. In the exemplary embodiment, shoulder 734 may have a suitable camping surface 734S that engages mating feature 732, and cams plunger 726 allowing rotation of butt portion 802 (in the direction indicated by arrow S) from position D to position D1, thus engaging the release 680 and releasing portion 634 to slide along post 672. In this manner, portion 634 is both foldable and collapsible along first axis 678 and second axis 740 about pin 804. In the embodiment shown sleeve 670 and post 672 cross sections are shown as general inverted "T" cross-section in section preventing rotation of portion 670 relative to portion 672 when released. In alternate embodiments, any suitable shapes may be used, for example, a square, rectangle or having a general "L" shaped cross-section.

Figure 26:
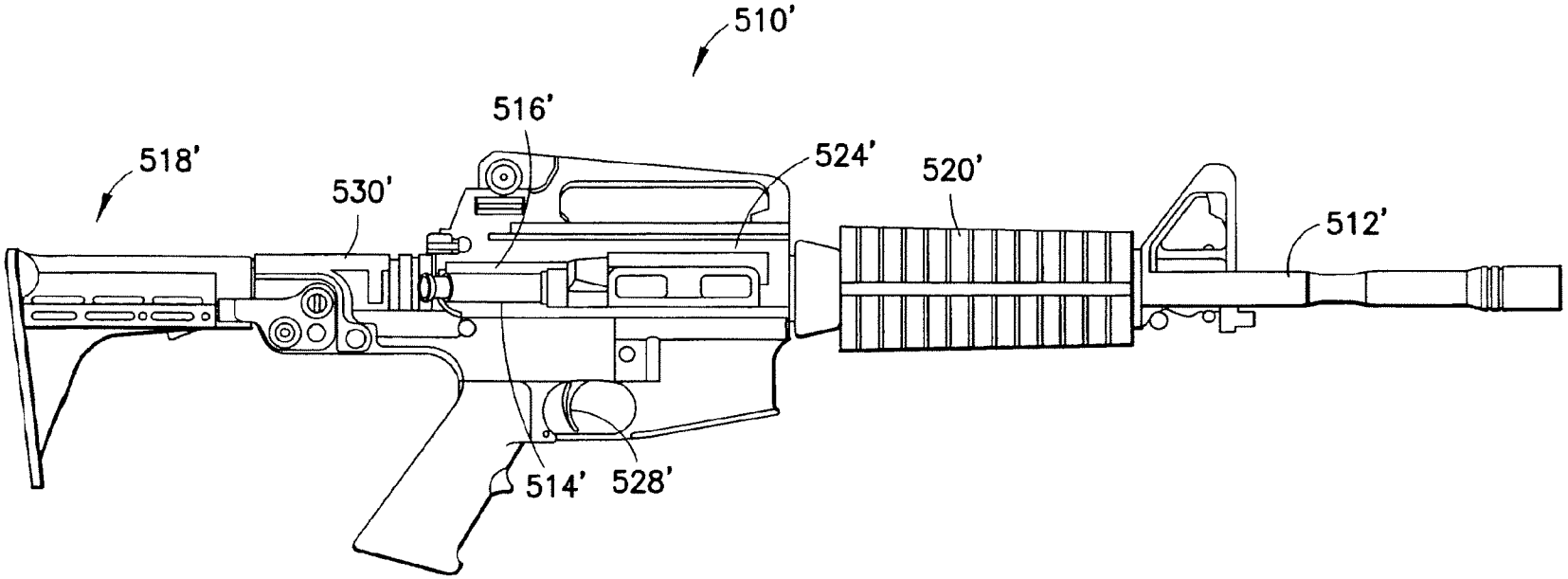
FIG. 26 is a side view of an automatic or semiautomatic firearm incorporating features in accordance with another exemplary embodiment.

Referring now to FIG. 26, there is shown a schematic side view of a firearm 510 in accordance with another exemplary embodiment. Firearm 510, may be an automatic or semiautomatic rifle, and is illustrated as generally having a what is generally known as a "blackrifle" configuration described before. However, the features of the disclosed embodiments, as will be described below, are equally applicable to any desired type of automatic firearm. Firearm 510 may be similar to firearm 10, 110, 210, 10' described before. The rifle 510 generally has a lower receiver 514, an upper receiver 516, a barrel 512 and stock 518. The upper receiver 516 may be connected to the lower receiver 514 to form a receiver assembly. The barrel 512 is connected to the receiver assembly as is the stock 518. The firearm may have a hand guard 520 over the barrel 512. In alternate embodiments, hand guard 520 may be of unitary construction with upper receiver assembly 516. The configuration of the firearm 510 in the exemplary embodiment illustrated in FIG. 26 is merely representative, and the features of the exemplary embodiments described below with specific reference to the figures are equally applicable to any suitable firearm with any desired configuration. In alternate embodiments, the firearm may have any other desired configuration and features. As noted before, the firearm 510 in the exemplary embodiment may be a rifle capable of automatic or semi-automatic fire. The firearm 510 may have an operating system 522, for example actuated by exhausting barrel gases, that cycles a bolt carrier 524 in the upper receiver to effect automatic or semi-automatic operation of the firearm. The operating system may be a direct gas impingement operating system, or in alternate embodiments may be an indirect or gas piston operating system. The firearm 10 may have a selector mechanism that interfaces with the firearm trigger system 528 to allow operator selection between, for example "AUTO" (automatic) "SEMI" (semiautomatic) and "SAFE" (safety) operating modes. Cycling of the bolt carrier 524 is effected by a direct or indirect gas operating system in cooperation with a bolt carrier return system 530. The bolt carrier return system 350 may be located in the stock 518 of firearm 510. In the exemplary embodiment shown in FIG. 26, the stock 518 is a folding stock as will be described in greater detail below. The stock 518 may also have a telescoping or extendable portion providing the stock with selectably variable length.

Figure 27:
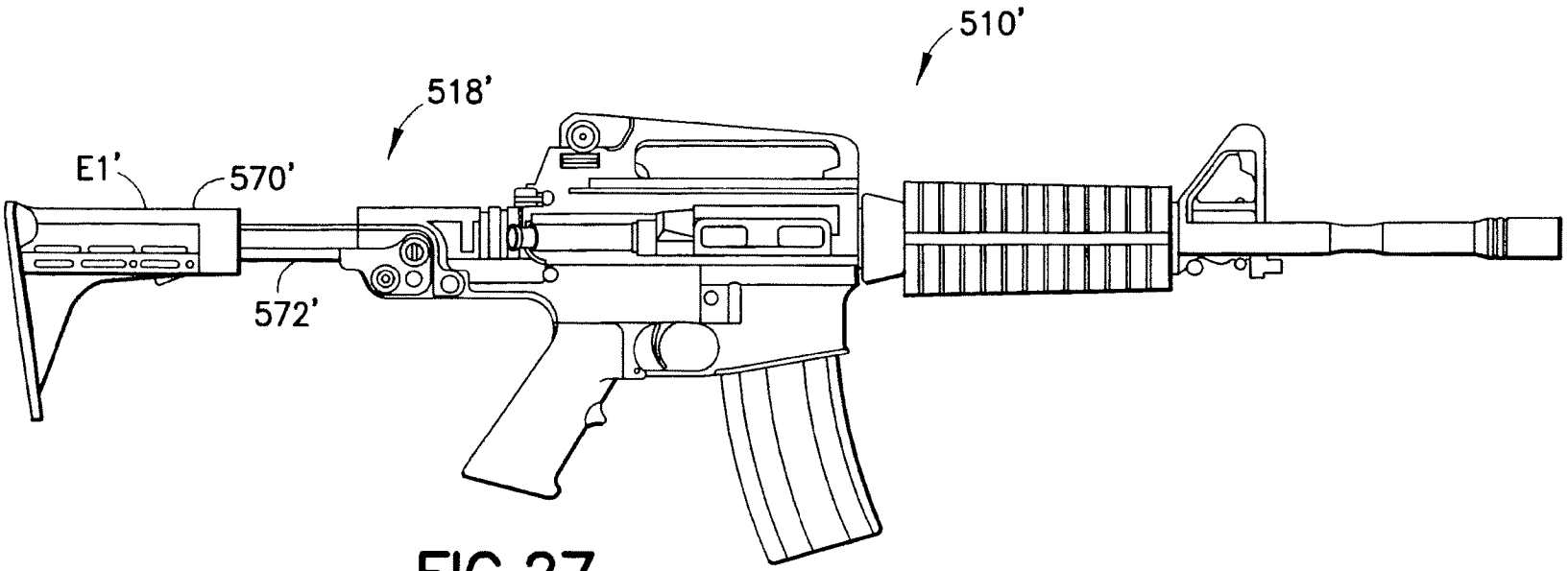
FIG. 27 is a side view of the firearm with a folding stock shown in a first position.
Figure 28:
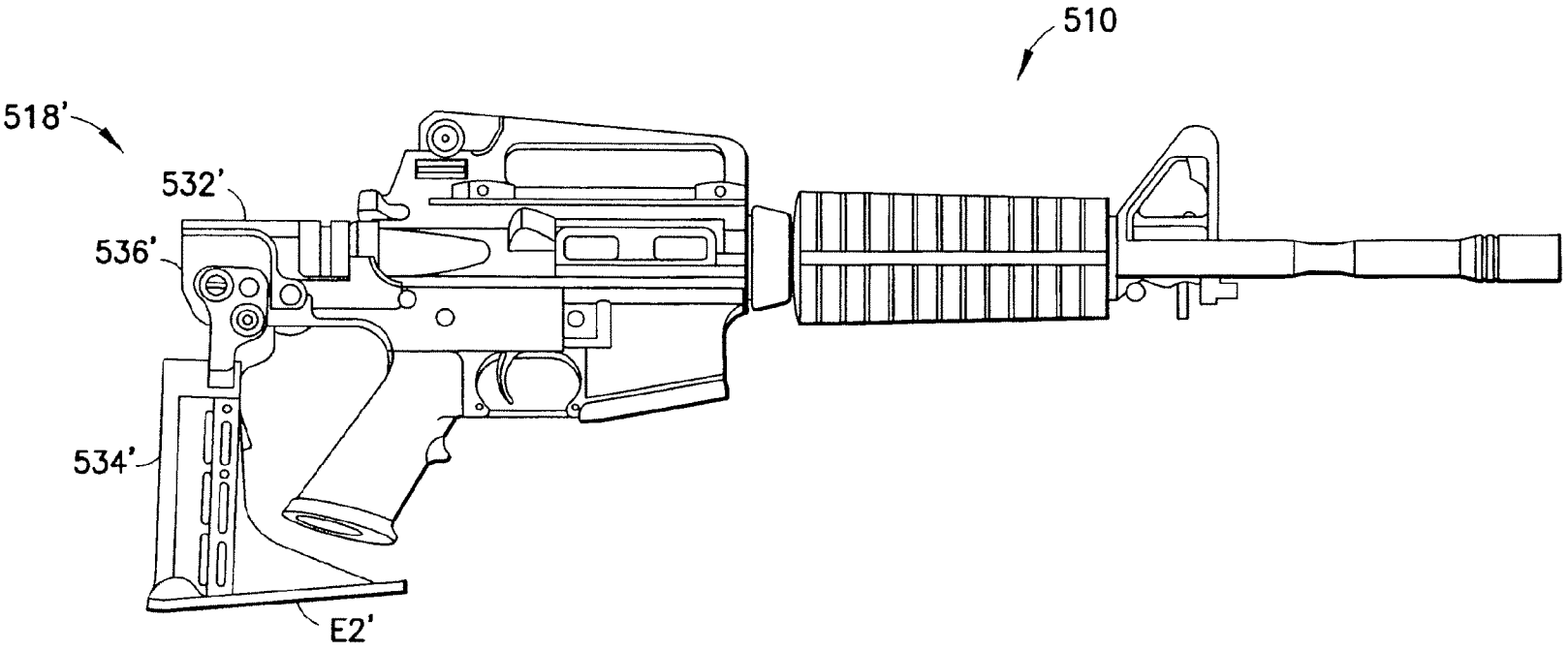
FIG. 28 is a side view of the firearm with a folding stock shown in a second position.
Figure 29:
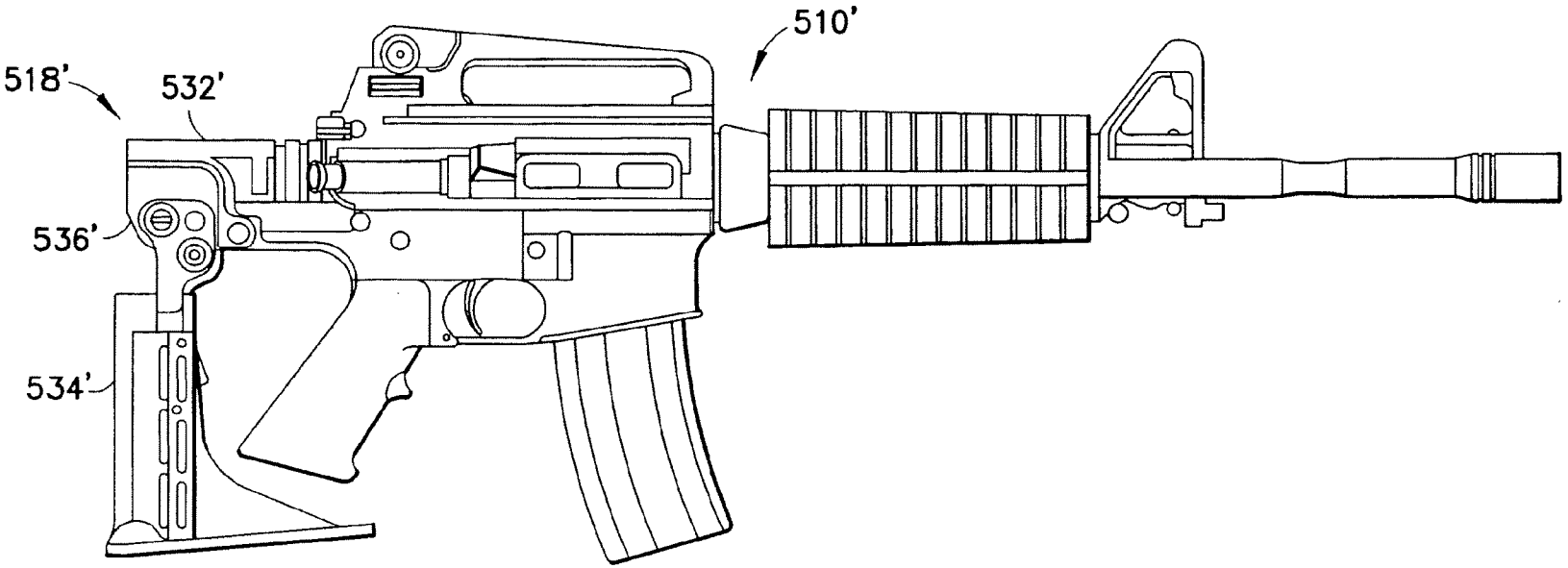
FIG. 29 is a side view of the firearm with a folding stock shown in a second position.
Figure 30:
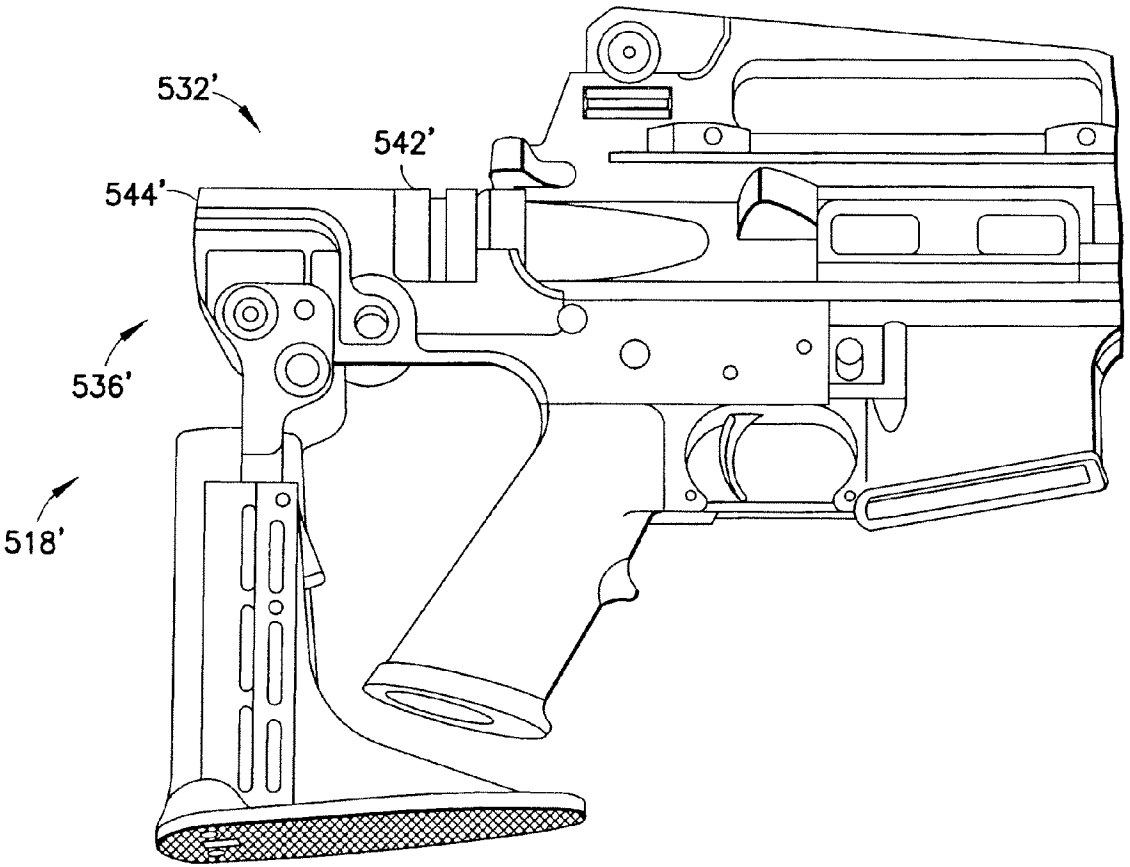
FIG. 30 is a partial side view of the firearm with a folding stock shown in a second position.

Referring now to FIG. 27, there is shown a side view of an automatic firearm with a folding stock shown extended to a representative extended position E1. Referring also to FIGS. 28, 29 and 30, there is shown a side view of an automatic firearm with a folding stock shown in a folded position E2. As seen in FIG. 28, in the exemplary embodiment, the stock 518 may have what may be generally referred to as a base portion 532 and folding portion 534. The base portion 532 of the stock 518, mates the stock to the lower receiver 514. The folding portion 534 is joined to the base portion 534 by a coupling 536 that allows the folding portion 534 to be folded, or rotated relative to the base portion 518 from a deployed position (or unfolded position as illustrated in FIG. 26 for example) to a folded or stowed position(s) E2 (shown for example in FIGS. 28-30) as will be described further below. In the exemplary embodiment illustrated in the FIGS. 28-30, the folding portion 534 is shown for example folded with the butt portion is rotatable about a substantially horizontal axis of rotation R' (see FIG. 31) from a raised or deployed position (FIGS. 26 and 27) to a folded, lowered or stowed position E2 (FIG. 28-30). In alternate embodiments, the folding portion of the stock may have more than one folded position. For example the folded portion of the stock may be folded on the right or left side of the firearm. In other alternate embodiments, the folding portion may be moved to any other desired folded position. As may realized, the bolt carrier 524 is movably mounted inside the upper receiver 516. The action system 530 is interfaced with and engages the bolt carrier to return the carrier 524 to its battery position during each operating cycle. The action system 530 may be housed, at least in part, within the base portion 532 of the stock 518 for example, in a manner similar to that described previously. As can be seen in FIG. 30, the stock base portion 532, connecting the stock 518 to the rear end of the lower receiver, may generally include a receiver extension member 542, and a stock base portion 544. The stock base portion may be generally similar to the stock base portion 44', 344, 644 described previously and shown in FIGS. 11, 14 and 25. In alternate embodiments, the base portion may have any other desired configuration. In the exemplary embodiment, the receiver extension member 542 is communicably connected to the lower receiver 514. The receiver extension member 542 is located within the stock base portion 544. In the exemplary embodiment, the receiver extension member 542 may have a generally hollow cylindrical shape. The receiver extension member is sized and shaped to house and allow desired movement of the bolt carrier action system 530 and bolt carrier 524 as the bolt carrier is cycled during operation of the firearm. In alternate embodiments, the receiver extension member may have any other desired shape. In the exemplary embodiment, the bore within the receiver extension member 542 may be sized to stably support a spring, of the bolt carrier action system 530 and allow unimpaired deflection of the spring as the bolt carrier cycles. As noted before, in alternate embodiments any suitable spring or bolt carrier return system may be used. The bore may also define a guideway for movement of a buffer and bolt carrier 524 when the bolt carrier cycles during operation of the firearm. In the exemplary embodiment the extension member 542 may have a threaded portion at its front end for engagement to the receiver 514 of the firearm. In the exemplary embodiment, the receiver may have an aperture with internal threads allowing the extension member 42 to be threaded into the aperture, thereby mounting the extension member 542, and the stock 518 to the receiver. In alternate embodiments, the extension member may be mounted to the receiver in any other desired manner. As may be realized, the extension member 542 in the exemplary embodiment is substantially shorter than a conventional receiver extension tube of a "black rifle" such as an M4™ rifle. The extension member 542 is sized so that in cooperation with the action system 530, it allows the desired action of the bolt carrier action system 530 and bolt carrier 524 at a desired cycle rate when operating the firearm. For example, the rifle 510 may have a cycle rate similar to the cycle rate of an M4™ rifle. In alternate embodiments, the firearm may have any other desired cycle rate. In the exemplary embodiment the extension member 542 may have a minimum length of about 3.3", though in alternate embodiments, the extension member may have a length that is more or less.

Figure 31:
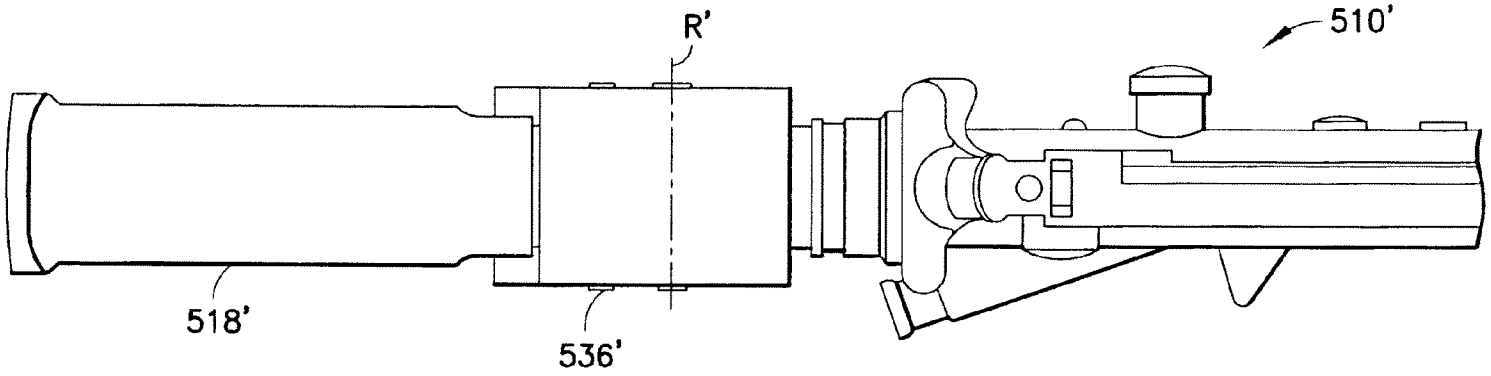
FIG. 31 is a partial top view of the firearm.
Figure 34:
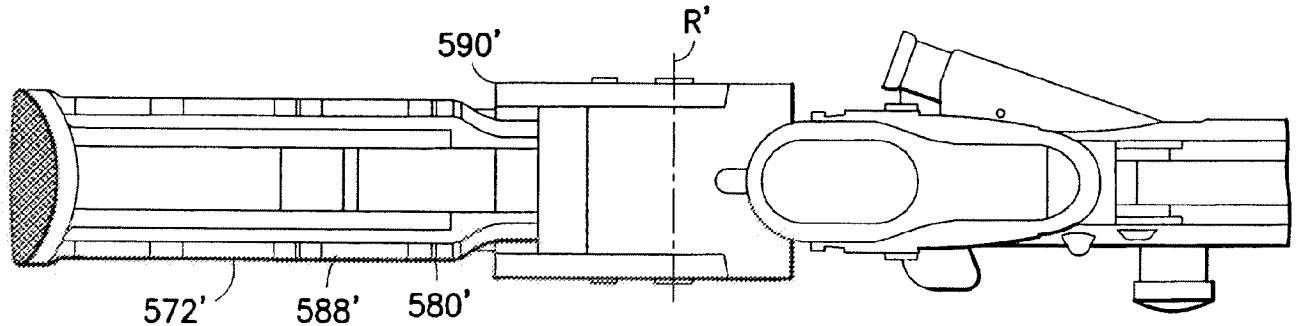
FIG. 34 is a partial bottom view of the firearm.
Figure 32:
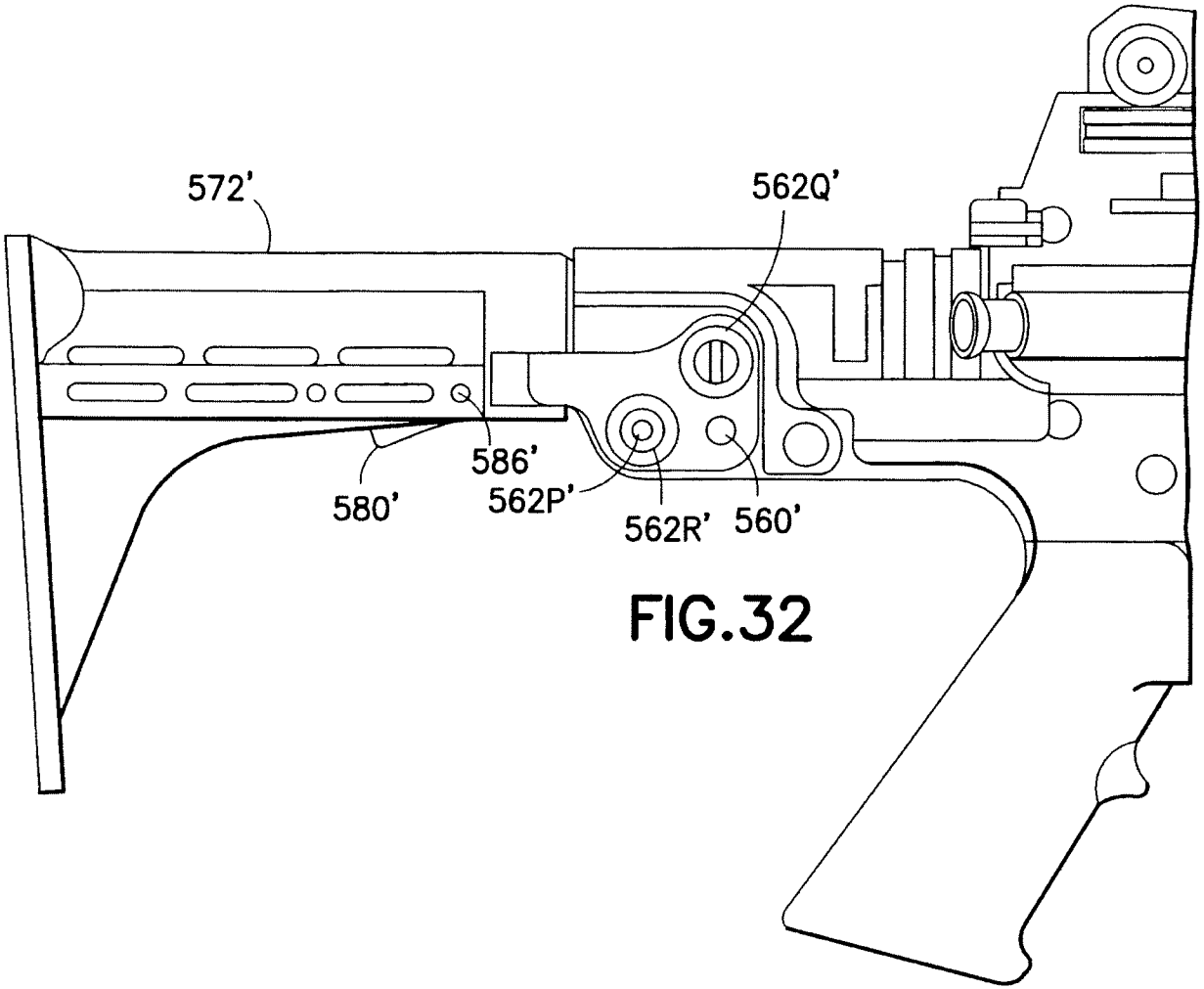
FIG. 32 is a partial side view of the firearm with the stock in the first position.
Figure 33:
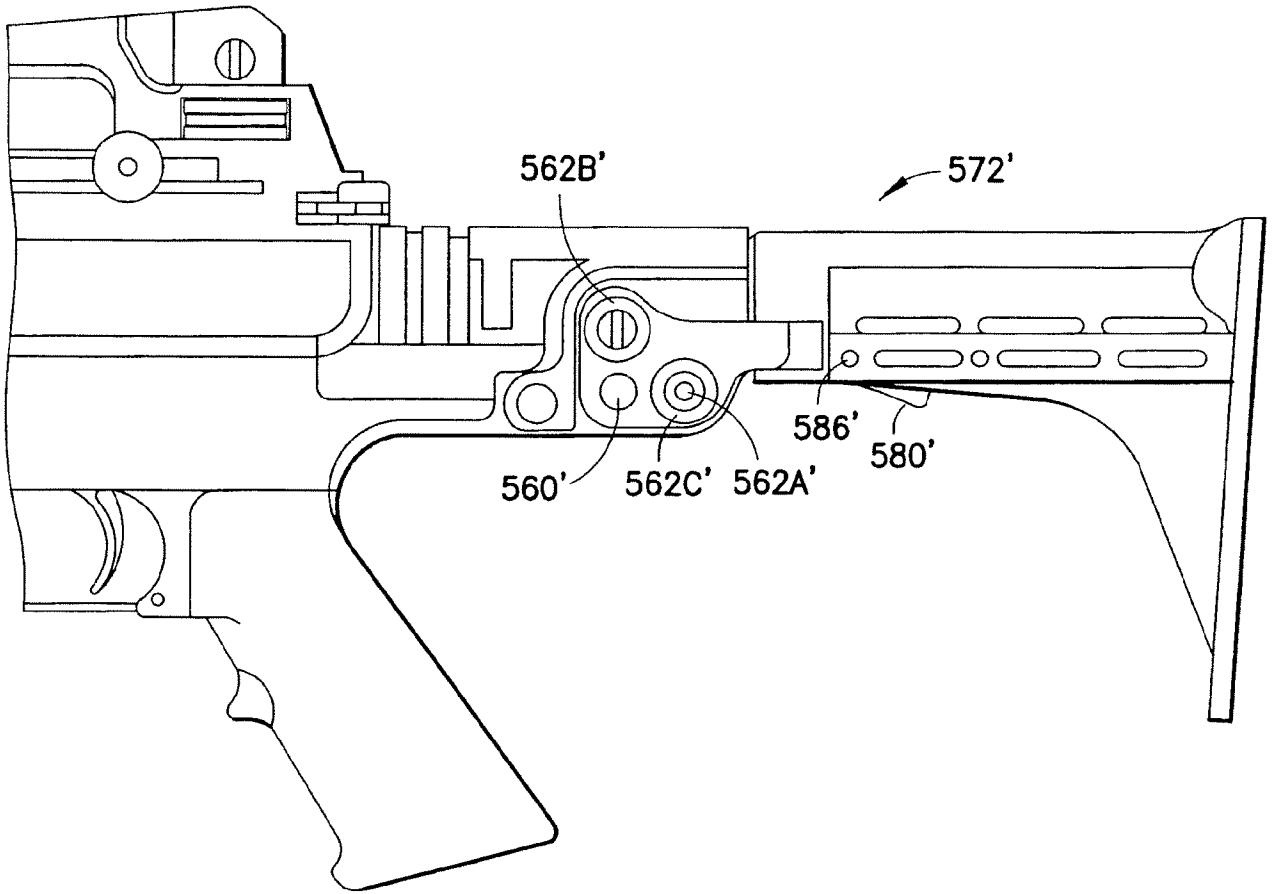
FIG. 33 is another partial side view of the firearm.
Figure 35:
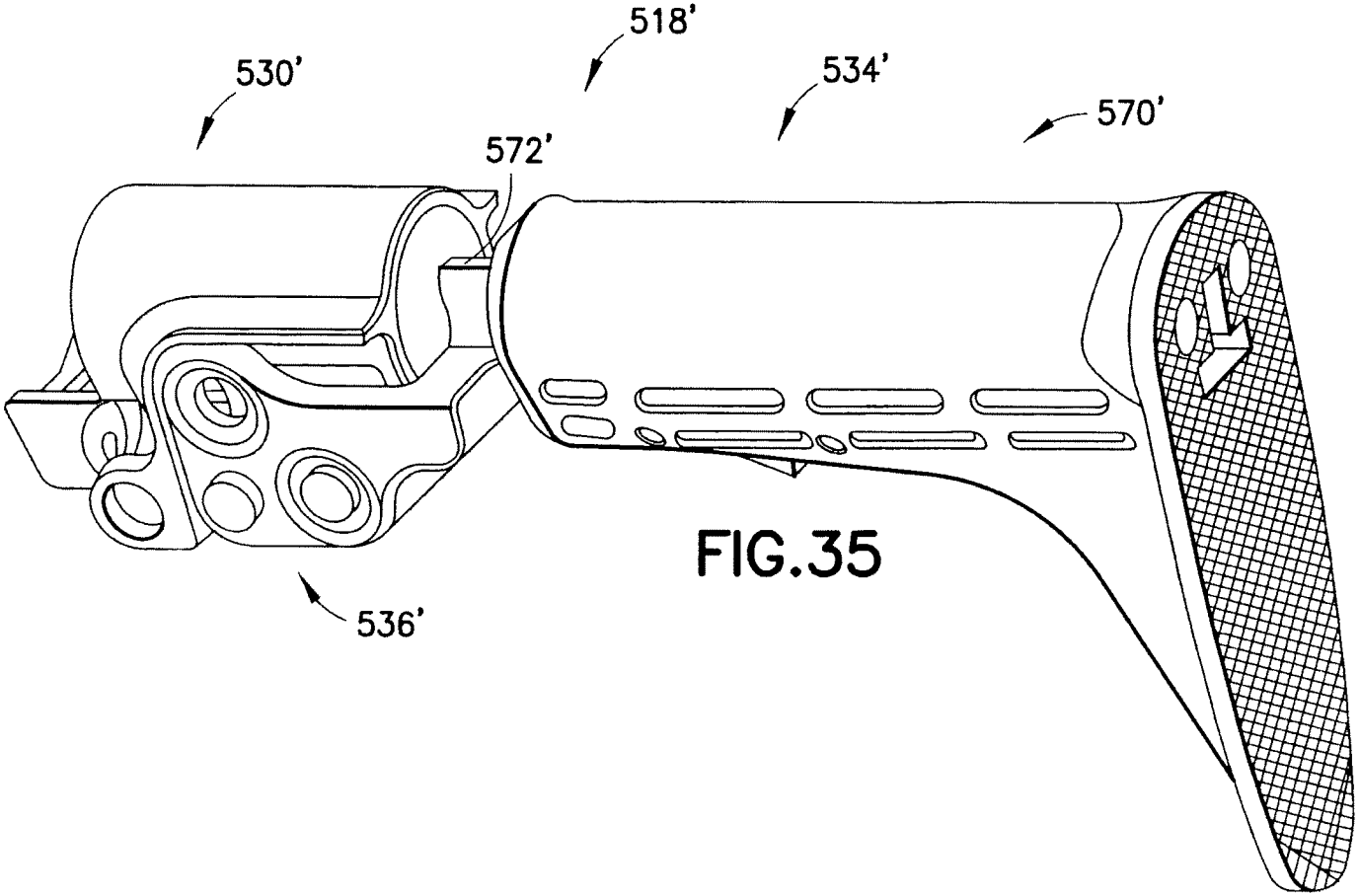
FIG. 35 is a partial isometric view of the firearm.
Figure 36:
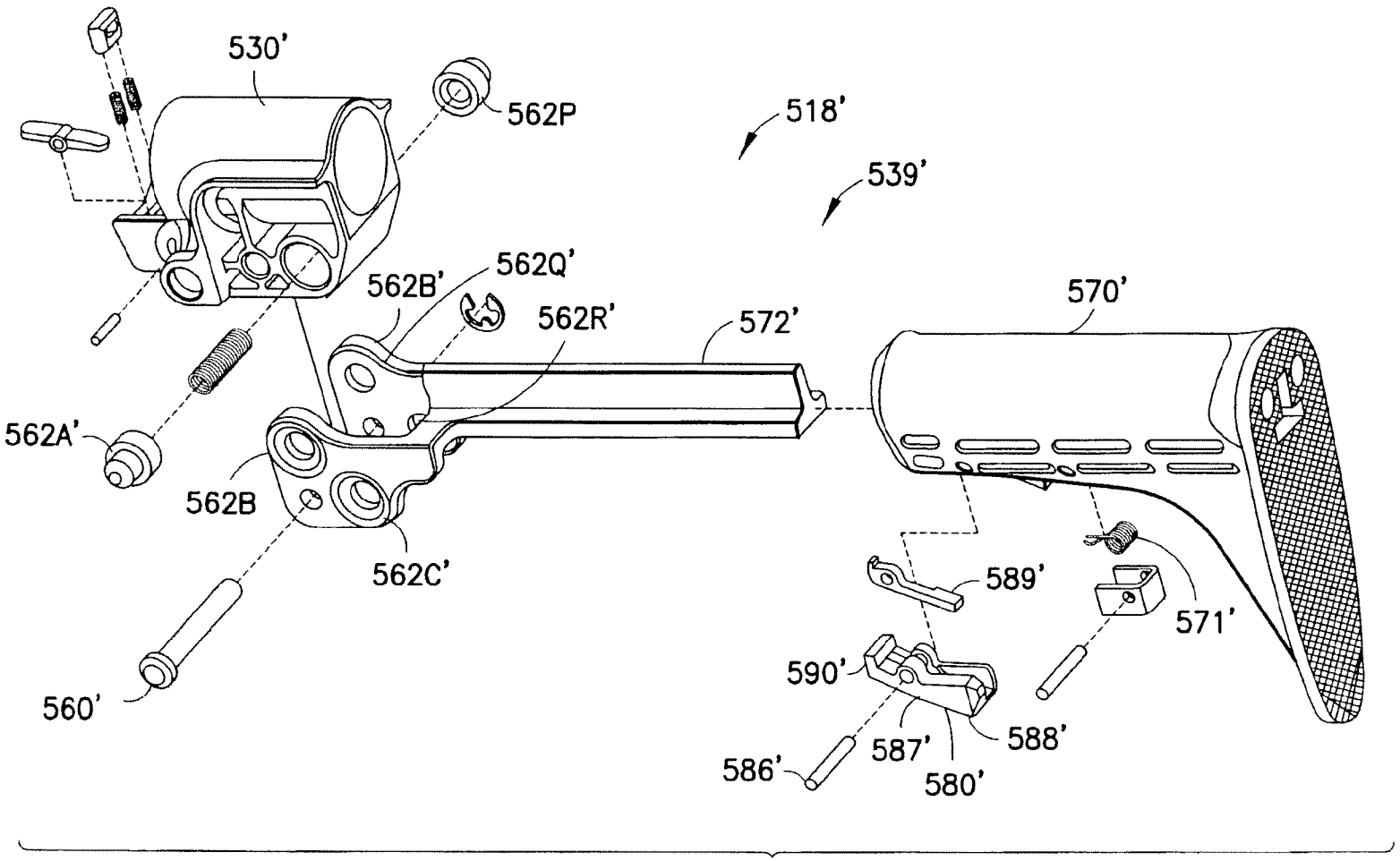
FIG. 36 is an exploded view of a rear portion of the firearm.

The base 544 of stock base portion 532 has a bore formed therein allowing the base to be mounted to the receiver extension 542. The base may be made from any suitable material such as aluminum and may be of unitary construction. The base 544 may be removably mounted to the receiver extension 542 for example, by a spring loaded latch engaging a detent on the receiver extension, or any other desired position fixing devices/features. The base may have mating feature generally conforming to a corresponding feature on the receiver extension or receiver. In the exemplary embodiment, the base may have locating features (e.g. detents) to positionably locate the base with respect to the firearm receiver. In the exemplary embodiment the stock base 544 may be, made of suitable material such as a non-metallic material (e.g. plastic). As noted, coupling 536 connects the end or folding portion 534 of the stock 518 to the base portion 532 and particularly in the exemplary embodiment, to the stock base 544. FIGS. 28-30 show the stock 518 in the folded position E2, and FIGS. 26, 27 and 31-34 illustrate the stock in the deployed or unfolded position. In the exemplary embodiment, coupling 536 incorporates a single degree of freedom, (e.g. a single axis of rotation R' as shown in FIGS. 31 & 34). In alternate embodiments, the coupling may have multiple degrees of freedom (e.g. multiple axis of rotation allowing the folding portion to be rotated to either side and/or rotated vertically). The coupling may also include a quick release allowing rapid removal and reinstallation of the folding stock portion 534 from the stock base 532. The configuration of the coupling 536 in the illustrated embodiments is merely exemplary, and in alternate embodiments the coupling may have any other suitable configuration. In the exemplary embodiment, the coupling 536 may have a hinge 560 (see FIGS. 32 & 33) located to allow the folding portion to be rotated from the deployed position to the stowed, lowered position. In the exemplary embodiment, the hinge 560 may be located under the extension member, though in alternate embodiments the hinge may be located in any other desired position. Referring also to FIGS. 35 & 36, spring loaded detents 562P, 562A are recessed and engage automatically into corresponding mating bores 562Q, R; 562 B, C of the folding portion to lock the folding portion respectively in its folded position E2 (see FIGS. 32 & 33) and deployed position (see FIGS. 26-27). Spring loaded detents 562P, 562A act as push pins, and when pressed in disengage mating bores 562Q, 562B (see FIGS. 32 & 33) in folding portion 534 when in the folded position E2. Similarly, spring loaded detents 562P, 562A act as push pins, and when pressed in disengage mating bores 562R, 562C (see FIGS. 32 & 33) in folding portion 534 when in the deployed or raised position. Spring loaded detents 562P, 562A may be tapered at their ends generally forming camping surfaces to allow for smooth engagement with bores 562 Q, R; 562 B, C of folding portion 534 as it is rotated into folded or deployed position. Similarly, mating bores 562Q, 562B and 562R, 562C may be chamfered on their exposed sides to allow for relief for fingers of the user when pressing detents 562P, 562A. The mating bores 562Q, 562B and 562R, 562C on the folding portion and stock base housing fix the folding portion to the base when the folding portion is in its deployed or stowed position. Folding portion 534 may incorporate a telescoping system allowing the folding portion to have a selectably variable length. The length of the folding portion may be adjusted/selected as desired with the folding portion in either the folded or deployed positions. In the exemplary embodiment (FIG. 27) folding portion 534 has butt stock 570 capable of being extended along extension member 572. Extension member 572 may have an L or T shape that mates with a similar feature in stock 570 to prevent rotation. In alternate embodiments, any suitable shape may be used or alternately, stock 570 may also be rotatable about member 572. The butt stock 572 may include a release 580 shown best in FIG. 36 that may be spring loaded to a locked position. The release 580 locks the position of butt stock 570 to extension member 572. In the example shown, release 580 pivots about pin 586 and may be depressed on its rear portion 588 to overcome the spring load. Upon pressing rear portion 588, engagement portion 590 is withdrawn, disengaging mating features, for examples a plurality of spaced mating slots, on extension member 572 and allowing butt stock 570 to be moved relative to extension member 572. Here, butt stock 570 may be slid along extension tube 572 from a full back position (similar to position E' shown in FIG. 27) to a full forward position (see FIGS. 26, 28-34). In the exemplary embodiment, release 580 may have a latch assembly with multiple latch pieces 587, 589. Latch piece 589 may be positioned within a recess in latch piece 587, both latch pieces being hinged on pin 586. Latch piece 589 may define an intermediate surface engaged by spring 571, which biases piece 589 against outer latch piece 587 biasing piece 587 in the locked position. In alternate embodiments, the release may have any other desired latch configuration.

Referring again to FIGS. 28-30, in the exemplary embodiment the folding butt portion 534, when in the folded position E2, is located substantially under the receiver. Hence, when the stock is folded, the width of firearm 510 (such as seen from the top or bottom) is substantially the same as when the folding butt portion is in the deployed position (as shown in FIG. 26). The width of the firearm may not change substantially when the buttstock is folded In accordance with one exemplary embodiment, an automatic or semiautomatic black rifle type rifle is provided. The rifle has a receiver and a bolt carrier movably coupled to the receiver. An action system is provided connected to the bolt carrier for cycling the bolt carrier in the receiver. A folding butt stock is provided connected to the receiver, the folding butt stock being both foldable and collapsible.

In accordance with another exemplary embodiment, an automatic or semiautomatic rifle is provided. The rifle has a receiver and a bolt carrier movably coupled to the receiver. An action system is provided connected to the bolt carrier for cycling the bolt carrier in the receiver. A folding stock is provided connected to the receiver, the folding stock having a first butt stock portion and a second butt stock portion. The first butt stock portion folds about a first axis. The second butt stock portion folds about a second axis different than the first axis.

In accordance with another exemplary embodiment, an automatic or semiautomatic black rifle type rifle is provided. The rifle has a receiver and a bolt carrier movably coupled to the receiver. An action system is provided connected to the bolt carrier for cycling the bolt carrier in the receiver. A telescoping butt stock is provided connected to the receiver.

In accordance with another exemplary embodiment, an automatic or semiautomatic rifle is provided. The rifle has a receiver and a bolt carrier movably coupled to the receiver. An action system is provided connected to the bolt carrier for cycling the bolt carrier in the receiver. A telescoping butt stock is provided connected to the receiver. The telescoping butt stock has a telescoping latch for locking the butt stock in a predetermined telescope position. The telescoping latch is configured so that a user squeezes the butt stock to release the telescoping latch.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the exemplary embodiments.

What is claimed is:

1. An automatic or semiautomatic rifle, comprising:

a receiver;

a receiver extension, secured to the receiver;

an action spring received within the receiver extension, the action spring cooperating with a bolt carrier for cycling the bolt carrier in the rifle, and a folding butt stock portion pivotally connected to the rifle at a distal end of the receiver extension with respect to the receiver, wherein the folding butt stock portion is capable of movement from a first position extending rearwardly from the distal end of the receiver extension to a second position wherein the folding butt stock portion extends forwardly from the distal end of the receiver extension, wherein the folding butt stock portion comprises a butt stock slidably mounted to an extension for movement between an extended position wherein the folding butt stock has a first length and an unextended position wherein the folding butt stock has a second length the second length being less than the first length, wherein the extension is pivotally secured the rifle by a coupling.

2. An automatic or semiautomatic rifle, comprising:

a receiver;

a receiver extension, secured to the receiver;

an action spring received within the receiver extension, the action spring cooperating with a bolt carrier for cycling the bolt carrier in the rifle, and a folding butt stock portion pivotally connected to the rifle at a distal end of the receiver extension with respect to the receiver, wherein the folding butt stock portion is capable of movement from a first position extending rearwardly from the distal end of the receiver extension to a second position wherein the folding butt stock portion extends forwardly from the distal end of the receiver extension, wherein the folding butt stock portion has an axis that is aligned with an axis of the receiver extension when the folding butt stock portion is in the first position, and wherein the axis of the folding butt stock portion is parallel with the axis of the receiver extension.

3. The rifle of claim 1, wherein the folding butt stock portion further comprises a butt portion pivotally mounted to the folding butt stock for movement between a first position wherein the butt portion is parallel to the axis of the folding butt stock portion and a second position wherein the butt portion is orthogonal to the axis of the folding butt stock portion.

4. An automatic or semiautomatic rifle, comprising:

a receiver;

a receiver extension, secured to the receiver;

an action spring received within the receiver extension, the action spring cooperating with a bolt carrier, and a folding stock connected to the receiver, the folding stock having a first butt stock portion and a second butt stock portion, wherein the first butt stock portion folds about a first axis at a distal end of the receiver extension with respect to the receiver, and wherein the second butt stock portion folds about a second axis proximate to a distal end of the first butt stock portion.

5. The rifle of claim 4, wherein the first butt stock portion is capable of movement between a first position, wherein an axis of the first butt stock portion aligns with an axis of the receiver extension and extends away from the distal end of the receiver extension in a rearward direction and a second position, wherein the axis of the first butt stock portion is no longer aligned with the axis of the receiver extension and wherein the second butt stock portion is slidably mounted to the first butt stock portion for movement between an extended and unextended position with respect to the first butt stock portion such that the folding stock is capable of having a variable length.

6. A folding butt stock for a rifle, comprising:

a folding butt stock portion pivotally connected to the rifle at a distal end of a receiver extension with respect to a receiver of the rifle, wherein the folding butt stock portion is capable of movement from a first position extending rearwardly from the distal end of the receiver extension to a second position wherein the folding butt stock portion extends forwardly from the distal end of the receiver extension, wherein the folding butt stock portion comprises a butt stock slidably mounted to an extension for movement between an extended position wherein the folding butt stock has a first length and an unextended position wherein the folding butt stock has a second length the second length being less than the first length, wherein the extension is pivotally secured the rifle by a coupling, wherein the folding butt stock portion further comprises a butt portion pivotally mounted to the folding butt stock for movement between a first position wherein the butt portion is parallel to the axis of the folding butt stock portion and a second position wherein the butt portion is orthogonal to the axis of the folding butt stock portion.

* * * * *